US006810381B1

(12) United States Patent
Sasaki et al.

(10) Patent No.: US 6,810,381 B1
(45) Date of Patent: Oct. 26, 2004

(54) AUDIO CODING AND DECODING METHODS AND APPARATUSES AND RECORDING MEDIUM HAVING RECORDED THEREON PROGRAMS FOR IMPLEMENTING THEM

(75) Inventors: Shigeaki Sasaki, Tokyo (JP); Kazunori Mano, Tokyo (JP); Shinji Hayashi, Tokyo (JP)

(73) Assignee: Nippon Telegraph and Telephone Corporation (JP)

( * ) Notice: Subject to any disclaimer, the term of this patent is extended or adjusted under 35 U.S.C. 154(b) by 0 days.

(21) Appl. No.: 09/568,810

(22) Filed: May 11, 2000

(30) Foreign Application Priority Data

May 11, 1999 (JP) ..... 11-130058

(51) Int. Cl.[7] ..... G10L 19/00

(52) U.S. Cl. ..... 704/500; 704/220; 704/207; 704/200.1; 704/219; 704/223

(58) Field of Search ..... 704/500, 200, 704/200.1, 220, 207, 219, 223

(56) References Cited

FOREIGN PATENT DOCUMENTS

| | | |
|---|---|---|
| DE | 2 318 029 A | 4/1998 |
| EP | 09258795 | 10/1997 |
| FR | 2 762 464 | 10/1998 |

OTHER PUBLICATIONS

Kataoka et al., "A Backward Adaptive 8kbit/s Speech Coder Using Conditional Pitch Prediction", Globecom, vol. 3, No. 2, Dec. 1991, pps. 1889–1893.

European Search Report, EP 00 11 0124, Oct. 11, 2001, pps. 1–2.

*Primary Examiner*—Richemond Dorvil
*Assistant Examiner*—Qi Han
(74) *Attorney, Agent, or Firm*—Connolly Bove Lodge & Hutz LLP

(57) ABSTRACT

In the CELP coding system a low-order synthesis filter and a cascade-connected synthesis filter formed by a cascade connection of low- and high-order synthesis filters are provided, a synthesized acoustic signal is estimated in a mode decision part for an input acoustic signal, and the estimated synthesized acoustic signal is subjected to inverse filtering by an inverse filter corresponding to the low-order synthesis filter and an inverse filter corresponding to the cascade-connected synthesis filter to obtain residual signals. That one of the synthesis filters which corresponds to the residual signal of smaller power is selected by a switch, and a codebook is searched for indices which will minimize the error between the output synthesized acoustic signal by the selected synthesis filter and the input acoustic signal.

62 Claims, 27 Drawing Sheets

AUDIO CODING AND DECODING METHODS AND APPARATUSES AND RECORDING MEDIUM HAVING RECORDED THEREON PROGRAMS FOR IMPLEMENTING THEM

BACKGROUND OF THE INVENTION

The present invention relates to a method for encoding an input acoustic signal with a small amount of information by an audio coding scheme which determines codebook indices that will minimize an error between the input acoustic signal and a synthesized signal by its encoding, and a method for decoding the encoded information into the acoustic signal with high quality.

The CELP (Code Excited Linear Prediction) coding is a typical example of conventional low bit rate audio coding through a linear prediction (LP) coding scheme. FIG. 1 is a block diagram for explaining the general outlines of the CELP coding scheme. An input acoustic signal is applied via an input terminal 11 to an LP coding part 12, which performs an LPC analysis of the acoustic signal for each frame of about 5 to 20 ms to obtain p-th order linear predictive (LP) coefficients $\hat{\alpha}_i$, where i=1, . . . , p. The LP coefficients $\hat{\alpha}_i$ are quantized in a quanization part 13, and the resulting quantized LP coefficients $\hat{\alpha}_i$ are set as filter coefficients in an LP synthesis filter 14. The transfer function of the LP synthesis filter 14 is expressed by the following Equation (1):

$$\frac{1}{A(z)} = \frac{1}{1 + \sum_{i=1}^{p} \alpha_1 z^{-1}} \tag{1}$$

An excitation signal for the LP synthesis filter 14 is stored in an adaptive codebook 15. The excitation signal (vector) is cut out of the adaptive codebook 15 in accordance with input codes from a control part 16, and the cut-out segment (vector) is repeatedly duplicated and connected together to form a pitch component vector of one frame length. The pitch component vector is fed to a multiplier 22, wherein it is multiplied by a gain $g_1$ selected from a gain codebook 17, and the multiplier output is provided as the excitation signal to the synthesis filter via an adder 18. A synthesized signal from the synthesis filter 14 is subtracted by a subtractor 19 from the input acoustic signal to generate an error signal. The error signal is provided to a perceptual weighting filter 20, wherein the error signal is weighted corresponding to a masking effect by the perceptual characteristic. The control part 16 searches the adaptive codebook 15 for indices (i.e., a pitch lag) that will minimize the power of the weighted error signal. Thereafter, the control part 16 fetches noise vectors from a fixed codebook 21 in a sequential order. The noise vectors are each multiplied in a multiplier 23 by a gain $g_2$ selected from the gain codebook 17, then each multiplier output is added by the adder with the pitch component vector previously selected from the adaptive codebook 15 then the adder output is applied as an excitation signal to the synthesis filter 14, and as is the case with the above, the noise vectors are chosen which minimize the energy of the perceptually weighted error signal from the perceptual weighting filter 20. Finally, for the respective excitation vectors selected from the adaptive and fixed codebooks 15 and 21, the gain codebook 17 is searched for the gains $g_1$, and $g_2$, which are determined such that the powers of the outputs from the perceptual weighting filter 20 are minimized.

FIG. 2 is a block diagram for explaining the general outlines of a decoding scheme for the CELP coded acoustic signal. An LP coefficient code in input codes provided via an input terminal 31 is decoded in a decoding part 32, and the quantized LP coefficients $\alpha_i$ obtained by this decoding are set as filter coefficients in an LP synthesis filter 33. A pitch index in the input codes is used to cut out a pitch component vector from an adaptive codebook 34, and a fixed codebook index is used to select random component vector from a fixed codebook 35. The pitch component and random component vectors thus provided from the codebooks 34 and 35 are multiplied in multipliers 52 and 53 by gains $g_1$ and $g_2$ selected from a gain codebook 36 in accordance with a gain index in the input codes, thereafter being added together by an adder 37, whose output is provided as an excitation signal to the LP synthesis filter 33. A post filter processes a synthesized signal from the synthesis filter 33 in a manner to decrease quantization noise from the viewpoint of the perceptual characteristics, and provides the processed signal as a decoded acoustic signal to an output terminal 39.

As described above, in the CELP or similar time-domain audio coding the conventional synthesis filter is formed by a 10th to 20th order LP auto-regressive linear filter for modeling the spectral envelope of speech, or its combination with a comb filter of a single pitch frequency modeled after a glottal source; hence, it is impossible to express a fine spectral structure of a musical sound which has many irregularly-spaced stationary peaks in the frequency domain. A method for reflecting the fine spectral structure in the synthesis filter is proposed by the inventors of this application in Japanese Patent Application Laid-Open Gazette No. 9-258795 and in literature "A 16 KBIT/S WIDEBAND CELP CODER WITH A HIGH-ORDER BACKWARD PREDICTOR AND ITS FAST COEFFICIENT CALCULATION," IEEE, pp.107–108, 1997 (hereinafter referred to as Literature 1). According to the proposed method, the LP synthesis filter in FIG. 1 is formed by a cascade connection of a p-th order (about 10th to 20th order, for instance) LP synthesis filter and a sufficiently higher n-th order LP synthesis filter. LP coefficients obtained by a p-th order linear prediction coding (LPC) analysis of the input signal is provided as coefficients of the p-th order LP synthesis filter, and LP coefficients obtained by an n-th order LPC analysis of a residual signal resulting from LP inverse filtering of a synthesized signal is provided as coefficients to the n-th order LP synthesis filter. With such a cascade-connected synthesis filters, it is possible to express the spectral envelope and fine structure of the input signal.

With the above method, in the coding apparatus of FIG. 1 the LP synthesis filter 14 is formed by a cascade connection of a p-th order LP synthesis filter of relatively low order (a 10th to 20th order synthesis filter commonly used in conventional speech coding, hereinafter referred to as a low-order synthesis filter) and an n-th order LP synthesis filter (a 100th or higher order synthesis filer, hereinafter referred to as a high-order synthesis filter). The low-order synthesis filter is used to define the spectral envelope of the input acoustic signal, and the high-order synthesis filter is used to express the fine spectral structure of the synthesized signal that cannot fully be expressed with the p-th order coefficients. Hence, it is possible to achieve higher audio coding quality.

This method allows expressing the envelope of the fine spectral structure, and hence it permits high quality encoding of a signal which has such a fine spectral structure containing a plurality of pitches as that of a musical sound. However, the use of the high-order synthesis filter means to obtain in a average spectrum of input signal samples in a long analysis window, but on the other hand it is impossible to detect short-time variations in the spectral structure, for example, fine or minute changes in the pitches as in the case of speech. For this reason, when this method is applied to a signal that has a component abruptly changing with time, such as a human vocal codes vibration or musical attack sound, the audio coding quality is degraded by an echo-like noise.

In literature by the inventors of this application, "Wide-band CELP Coding using Higher Order Backward Prediction of Residual," Technical Report of IEICE, SP97-64, pp.51–56, November, 1997 (hereinafter referred to as Literature 2), there is disclosed a scheme which employs a synthesis filter formed by a cascade connection of high- and low-order synthesis filters as proposed in the afore-mentioned Japanese patent application laid-open gazette and Literature 1, and it is described that the problem of quality degradation in speech coding can be solved by selectively switching between the cascade-connected synthesis filter and the conventional low-order synthesis filter, depending on whether the input signal is a music or speech signal. However, Literature 2 gives no description of how to distinguish between the music signal and the speech signal nor does it set forth a method for distinguishing a signal which contains a considerable amount of minute or fine variations in spectral structure from a signal which has a plurality of pitches mixed therein.

In the afore-mentioned Japanese patent application laid-open gazette, there is also described a method according to which: the output from the adaptive codebook 15 in FIG. 1 is added with a gain and is applied as an excitation signal to a p-th order LP synthesis filter; the output from a random codebook is added with a gain and is applied as an excitation signal to the afore-mentioned cascade-connected synthesis filter; the outputs from these two synthesis filters are added together to produce a synthesized signal; and the synthesized signal is provided to the subtractor 19. With this method, however, when the input acoustic signal is a music signal, the synthesized signal quality would be lower than in the case of using the cascade-connected synthesis filter alone for a composite excitation signal of a pitch vector and a noise vector, and the audio coding quality would be low accordingly.

SUMMARY OF THE INVENTION

It is therefore an object of the present invention to provide a method and apparatus for high quality time-domain audio coding based on the linear prediction scheme by selectively using the optimum synthesis filter in accordance with the characteristic of the signal to be encoded, and a method and apparatus for decoding the encoded signal, and a recording medium on which there are recorded programs for implementing such audio coding and decoding methods.

In the coding method and apparatus according to the present invention, at least one of an input acoustic signal and a synthesized acoustic signal is used to determine p-th order LP coefficients for a p-th order LP synthesis filter and p'- and n-th order LP coefficients for p'- and n-th order LP synthesis filters cascaded to each other to form a cascade-connected synthesis filter. The value p' is comparable to p and the value n is larger than p.

As estimated synthesis acoustic signal estimated from the input acoustic signal is subjected to inverse filtering by a first inverse filter of an inverse characteristic to the p-th order LP synthesis filter and by a second inverse filter of an inverse characteristic to the cascade-connected synthesis filter to obtain first and second residual signals. The first and second residual signals are estimated to be input excitation signals that are applied to the p-th order LP synthesis filter and the cascade-connected synthesis filter when the above-mentioned estimated synthesized acoustic signal is output. The first and second residual signals are used to decide which of the p-the order LP synthesis filter and the cascade-connected synthesis filter will provide higher audio coding quality.

An excitation signal is generated from excitation vectors selected from codebook means and is used to drive the decided synthesis filter to generate a synthesized acoustic signal. The codebook means is searched for indices which will minimize the error of the synthesized acoustic signal to the input acoustic signal.

In the above audio coding, the p-th order LP coefficients are computed by a p-th order LPC analysis of the input acoustic signal, the p'-th order LP coefficients are computed by a p'-th order LPC analysis on a previous synthesized acoustic signal, and the n-th order LP coefficients are computed by an n-th order LPC analysis on a residual signal obtained by inverse filtering of the previous synthesized acoustic signal or a previous excitation signal.

In the case where p=p' and one p-th order synthesis filter is used both as the p-th order synthesis filter and as the p'-th order LP synthesis filter, the input acoustic signal or a previous synthesized acoustic signal is LPC analyzed to determine the p-th order LP coefficients, and a residual signal obtained by inverse filtering of the p-th order LP coefficients or a previous excitation signal is LPC analyzed to determine the n-th order LP coefficients.

In the decoding method and apparatus according to the present invention, p-th order LP coefficients of p-th order LP synthesis filter are obtained by decoding input codes or making an LPC analysis of a previous synthesized acoustic signal, and p'- and n-th order LP coefficients of p'- and n-th order LP synthesis filters forming a cascade-connected synthesis filter are obtained by decoding the input codes or making an LPC analysis on the previous synthesized acoustic signal to produce the p'-th order LP coefficients, and by decoding the input codes or making an LPC analysis of a residual signal resulting from inverse filtering of the previous synthesized acoustic signal or by making an LPC analysis of a previous excitation signal to produce the n-th order LP coefficients.

The p-th order LP synthesis filter or cascade-connected synthesis filter is selected in accordance with an input mode code. An excitation signal is generated from excitation vectors selected from codebook means corresponding to input codebook indices, and the excitation signal is applied to the selected synthesis filter to generate a synthesized acoustic signal.

In the decoding process, too, it is possible to set p=p' and use the same p-th order synthesis filter both as the p-th order LP synthesis filter and as the p'-th order LP synthesis filter.

DETAILED DESCRIPTION OF THE PREFERRED EMBODIMENTS

Figure 1:
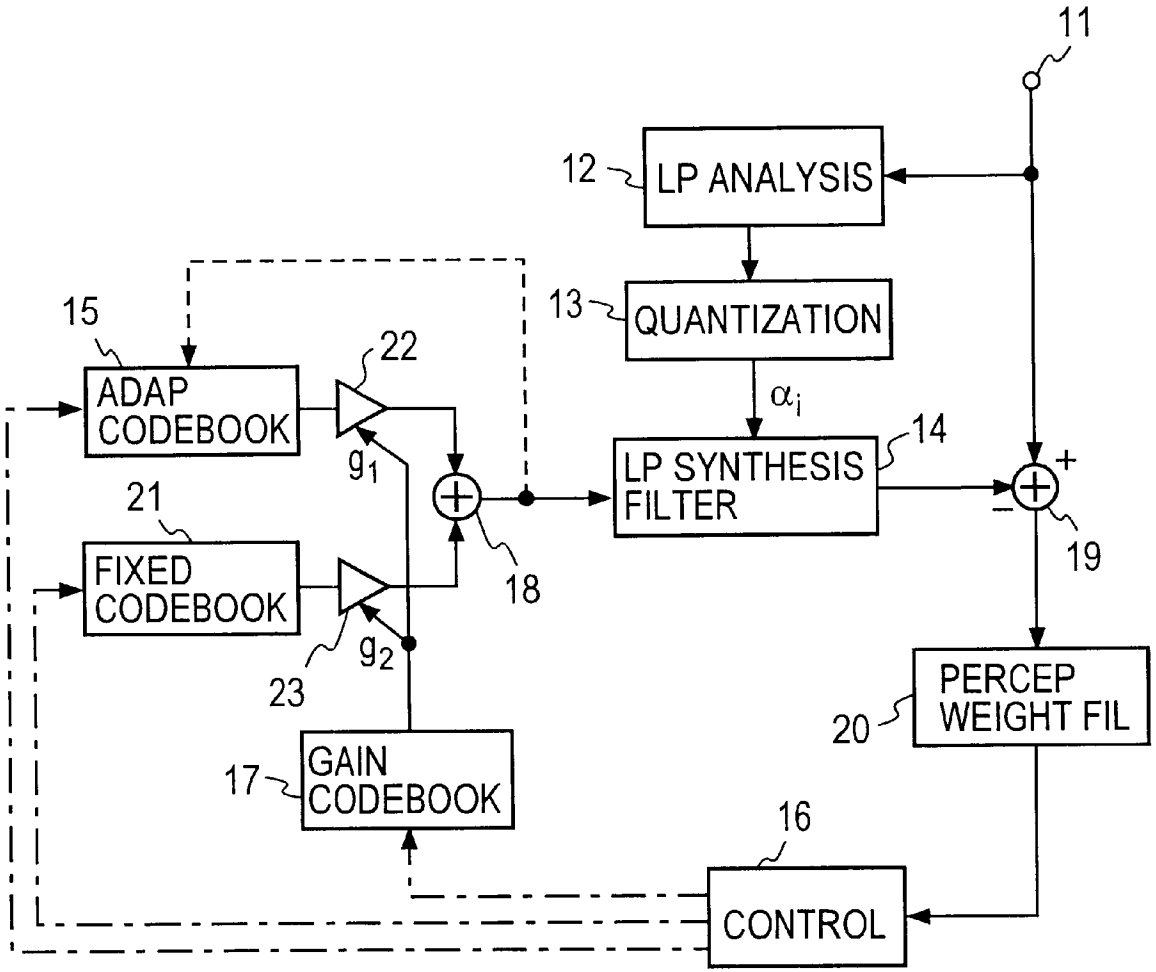
FIG. 1 PRIOR ART
FIG. 1 is a block diagram depicting a general configuration of a conventional CELP encoder.

A description will be given first, with reference to FIGS. 3 to 5, of the basic configuration of the coding apparatus and the coding method based on the principles of the present invention.

The present invention is common to the conventional CELP coding scheme in that an adaptive codebook, a fixed codebook and a gain codebook are searched for a set of indices which minimizes the error between the input signal and the synthesized signal. As depicted in FIG. 3, the coding apparatus according to the present invention comprises: an excitation signal generating part 100 which selects an excitation vector from a codebook and generates an excitation signal; a synthesis filter part 200 which has a low-order synthesis filter and a cascade-connected synthesis filter, a selected one of which is driven by the excitation signal and outputs a synthesized acoustic signal; coefficients determining part 300 which determines the filter coefficients of the synthesis filter part 200; a mode decision part (a mode discriminator) 41 which determines which of the synthesis filters in the synthesis filter part 200 is to be used according to an input acoustic signal; a subtractor 19 which generates an error between the input acoustic signal and the synthesized acoustic signal; and a control part 16 which searches codebooks in the excitation signal generating part 100 and selects an index which provides an excitation vector that minimizes the error.

The excitation signal generating part 100 includes the codebooks 15, 21 and 17, the multipliers 22 and 23, and the adder 18 in FIG. 1. The coefficients determining part 300 includes the LPC analysis part 12 and the quantization part 13 in FIG. 1.

Figure 4A:
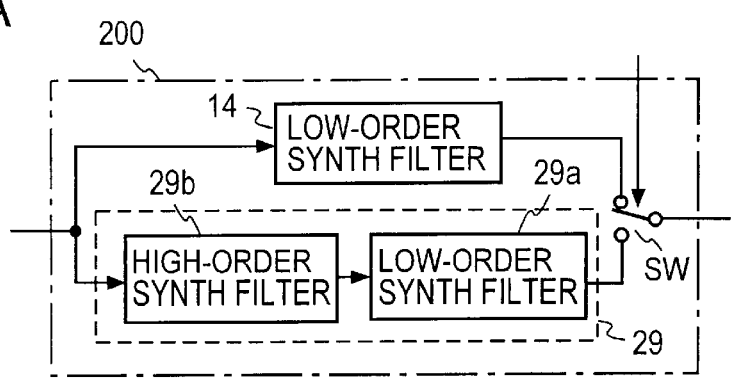
FIG. 4A is a block diagram depicting an example of the configuration of a synthesis filter part 200 in FIG. 3.

For example, as shown in FIG. 4A, the synthesis filter part 200 has a configuration in which either one of the low-order (p-th order) LP synthesis filter 14 and a cascade-connected synthesis filter 29 is selected by a switch SW in accordance with a select command from the mode decision part 41. The cascade-connected synthesis filter 29 is formed by a cascade connection of a low-order (p'-th order) synthesis filter 29A and a high-order (n-th order) synthesis filter 29B. p takes a value equal to or comparable to as p', and n takes a value significantly larger than p.

Figure 4B:
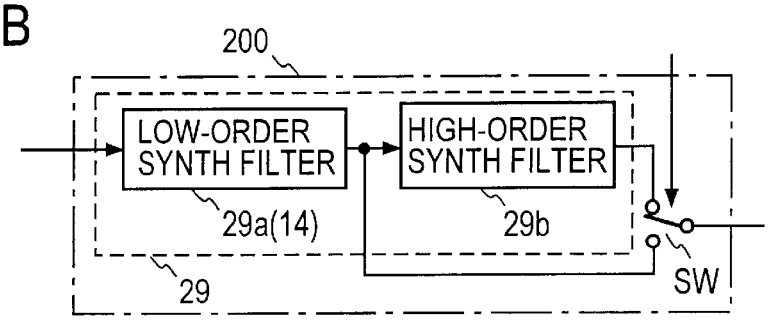
FIG. 4B is a block diagram depicting another example of the configuration of the synthesis filter part 200 in FIG. 3.
Figure 4C:
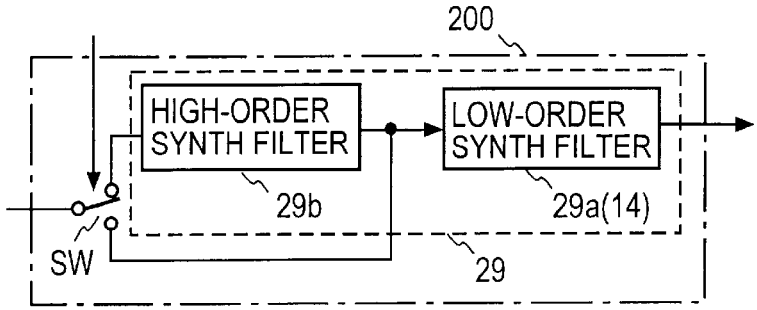
FIG. 4C is a block diagram depicting still another example of the configuration of the synthesis filter part 200 in FIG. 3.

The order of cascade connection of the high- and low-order synthesis filters may be reversed. Shown in FIG. 4B is a modified form of the configuration of the synthesis filter part 200, in which either one of the output from the cascade-connected synthesis filter 29 and the output from the low-order synthesis filter 29A is selected by the switch SW. Shown in FIG. 4C is still another modified form of the configuration of the synthesis filter part 200, in which the excitation signal is switched by the switch SW between the cascade-connected synthesis filter 29 and the low-order synthesis filter 29A.

The cascade connection of the low-order (p'-th order) synthesis filter 29A and the high-order (n-th order) synthesis filter 29B is used for such reasons as follows. For example, when an (n+p')th order LPC analysis is made of the input acoustic signal, a detailed spectral structure can be expressed for a large-power spectrum component and its vicinity but no fine spectral structure can be expressed in a small-power spectrum domain. In contrast thereto, the above-mentioned cascade-connected synthesis filter has an advantage that fine spectral structures can be expressed equally for the large-power spectrum component and its vicinity and for the small-power spectrum component and its vicinity.

The present invention features the mode decision part 41 by which it is decided which of the low-order synthesis filter 14 (or 29A) and the high-order synthesis filter 29B in the synthesis filter part 200 is to be used for the input acoustic signal so as to achieve high quality coding. Based on the decision, either one of the synthesis filters in the synthesis filter part 200 is selected.

Figure 3:
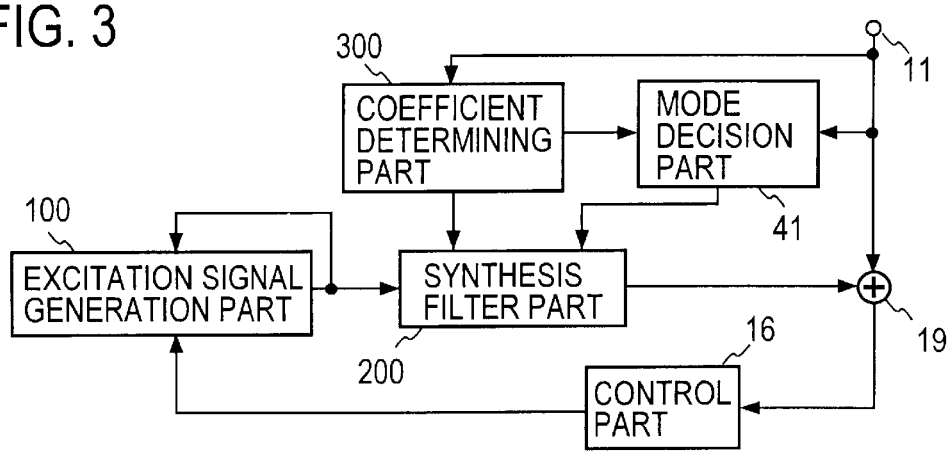
FIG. 3 is a block diagram illustrating an example of a basic functional configuration of the coding apparatus according to the present invention.
Figure 5:
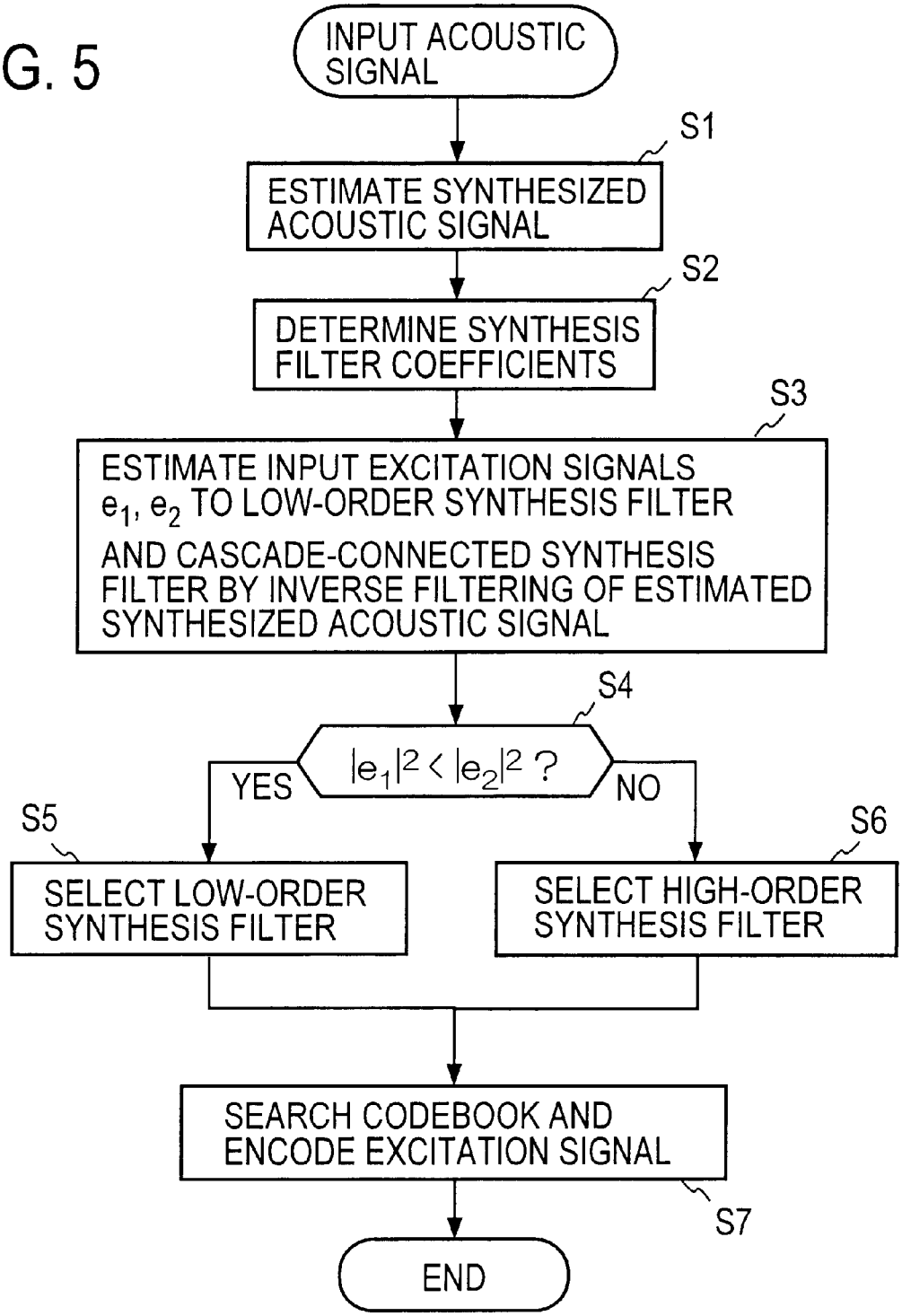
FIG. 5 is a flowchart showing the coding procedure by the coding apparatus of FIG. 3.
Figure 8:
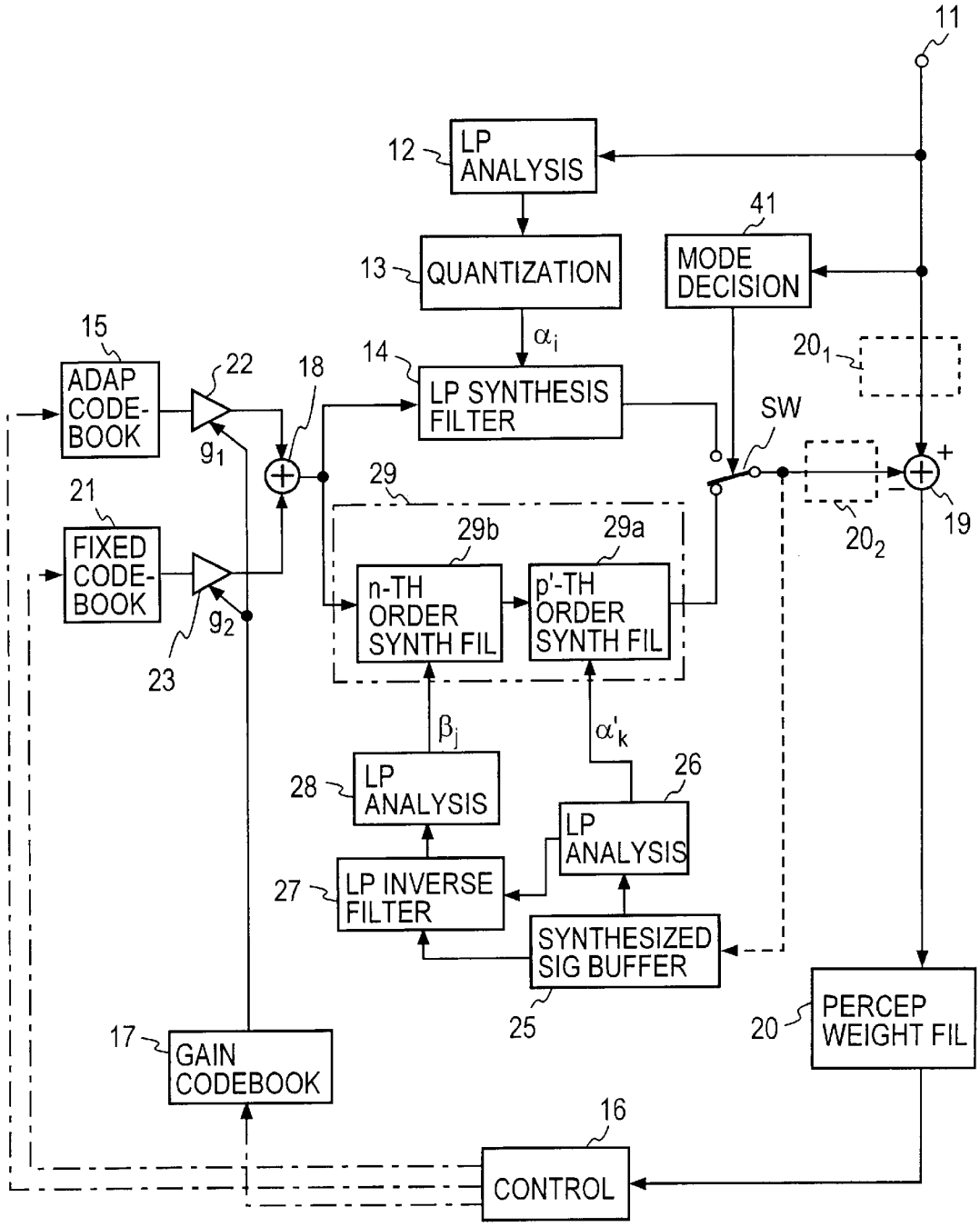
FIG. 8 is a block diagram illustrating the functional configuration of an embodiment of the coding apparatus according to the present invention.
Figure 9:
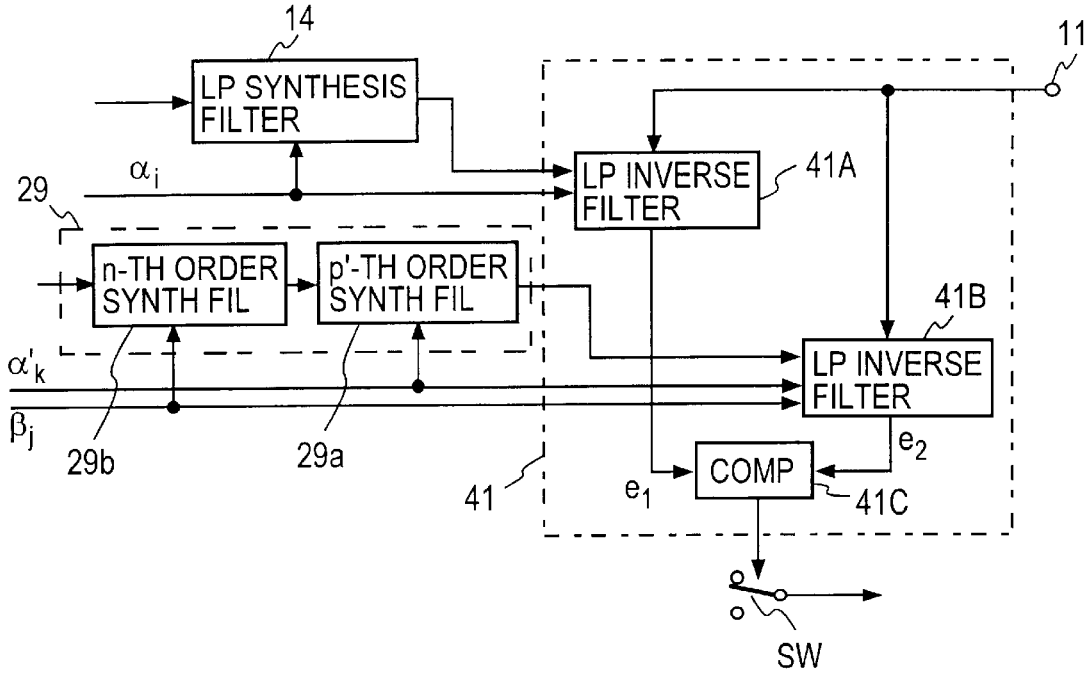
FIG. 9 is a block diagram depicting an example of a mode discriminator 41 in the FIG. 8 embodiment.

FIG. 5 depicts an example of the coding procedure by the coding apparatus of FIG. 3 (also see detail in FIGS. 8–9).

Step S1: For the input acoustic signal, the mode decision part 41 estimates a synthesized acoustic signal that is the output of the synthesis filter part 200. In the simplest case, the mode decision part 41 estimates that the synthesized acoustic signal will be approximate to the input acoustic signal. As will be described later on, when a perceptual weighting filter is employed, it is also possible to compute an estimated synthesized acoustic signal taking into account the filter characteristics.

Step S2: The coefficients determining part 300 makes an LPC analysis of the input acoustic signal and/or the previous synthesized acoustic signal and determines coefficients of the low-order synthesis filter 14 (29*a*) and the high-order synthesis filter 29*b* in the synthesis filter part 200. For example, the coefficients of the low-order synthesis filter 14 (29*a*) are calculated by an LPC analysis on the input acoustic signal or synthesized acoustic signal, whereas the coefficients of the high-order synthesis filter 29*b* are calculated by LPC-analyzing an excitation signal estimated form the previous synthesized acoustic signal or the previous excitation signal.

Step S3: The mode decision part 41 estimates, as input excitation signals to the low-order synthesis filter 14 and the cascade-connected synthesis filter 29, residual signals $e_1$ and $e_2$ resulting from inverse filtering of the estimated synthesized acoustic signal by inverse filters of the low-order synthesis filter 14 and the cascade-connected synthesis filter 29 of the coefficients determined as described above.

Step S4: Since the audio coding quality increases with a decrease in the power of the estimated excitation signal, the both estimated excitation signals are compared in power.

Step S5: If $|e_1|^2$ is smaller than $|e_2|^2$, then the switch SW is controlled to select the low-order synthesis filter 14.

Step S6: If $|e_1|^2$ is not smaller than $|e_2|^2$, then the switch SW is controlled to select the high-order synthesis filter 14.

Step S7: The control part 16 encodes the excitation signal for the selected synthesis filter by searching the codebooks in the excitation signal generating part 100 for indices that will minimize the error signal (the output from the subtractor 19) between the synthesized acoustic signal generated by the selected synthesis filter and the input acoustic signal.

Figure 2:
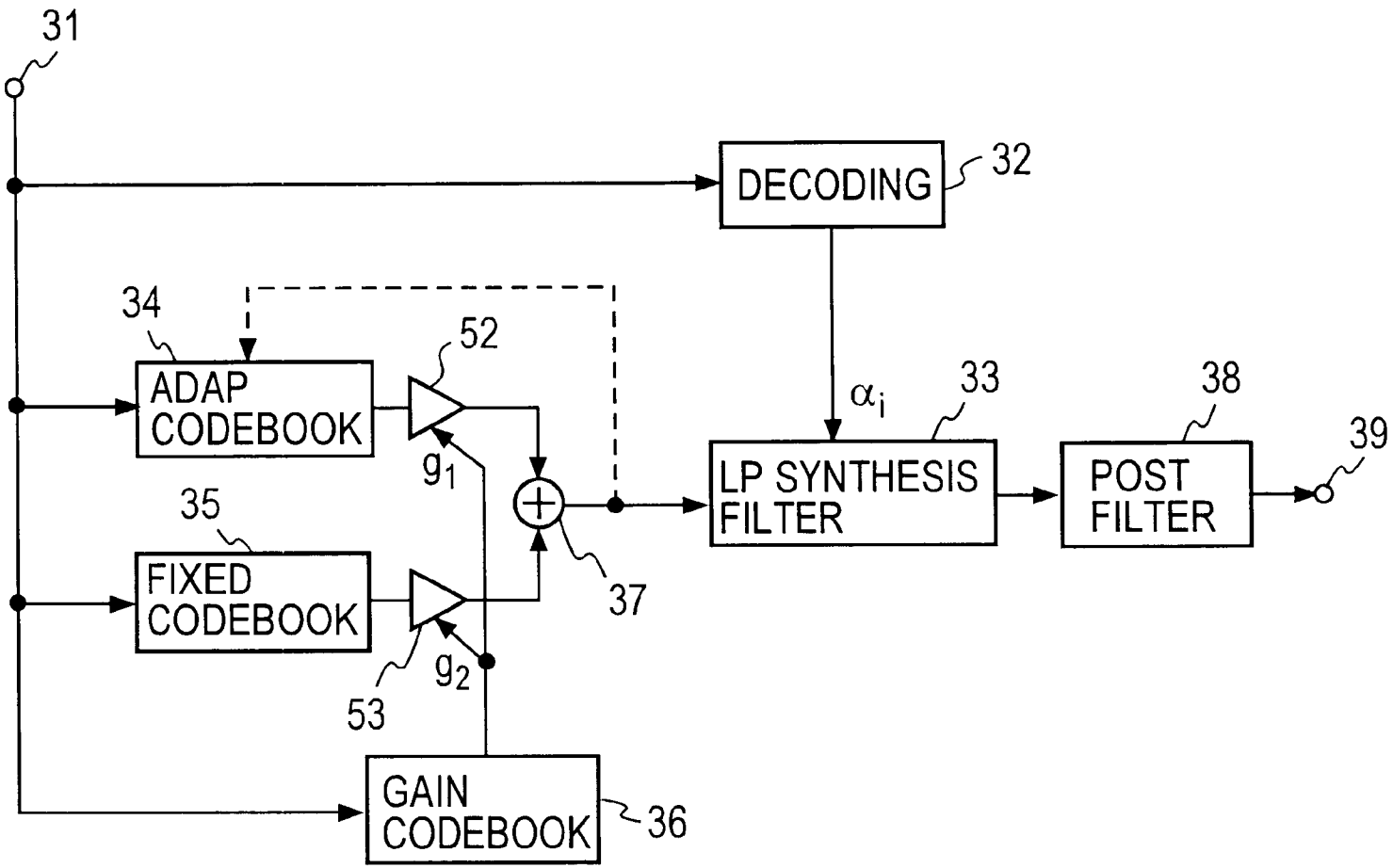
FIG. 2 PRIOR ART
FIG. 2 is a block diagram depicting a general configuration of a conventional CELP decoder.
Figure 6:
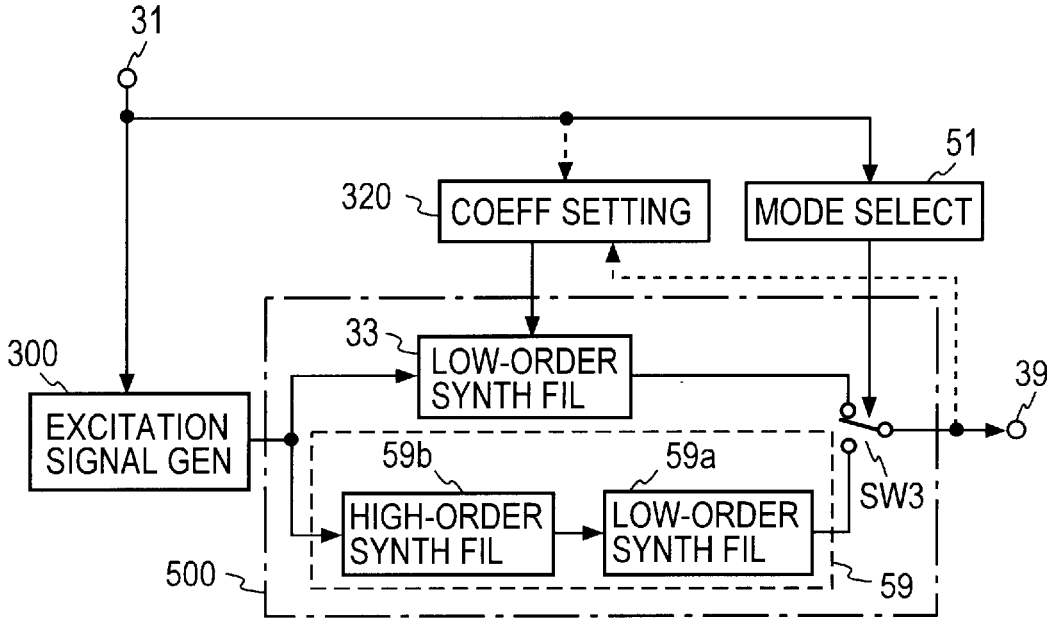
FIG. 6 is a block diagram depicting an example of a basic configuration of a decoding apparatus according to the present invention.

FIG. 6 illustrates in block form the functional configuration of the decoding apparatus according to the present invention. The decoding apparatus comprises an excitation signal generating part 300, a synthesis filter part 500, coefficients setting part 320 and a mode select part 51. The excitation signal generating part 300 includes the codebooks 34, 35, 36, the multipliers 52, 53 and the adder 37 in FIG. 2 and, as is the case with FIG. 2, multiplies decoded gains by a pitch component vector and a noise vector corresponding to input codebook indices and adds together the multiplied outputs to generate an excitation signal, which is applied to the synthesis filter part 500. The synthesis filter part 500 corresponds to the synthesis filter part 200 in the coding apparatus of FIG. 3, and hence it is formed by a low-order synthesis filter and a high-order synthesis filter as in FIG. 4B or 4C.

The coefficients determining part 320 may set LP coefficients, obtained by decoding the input codebook indices, in the low-order and/or high-order synthesis filter; alternatively, it may set in the low-order and/or high-order synthesis filter LP coefficients determined by an LPC analysis on a previous synthesized acoustic signal. The mode select part 51 responds to an input mode code to control a switch SW3 to select either one of the low-order synthesis filter and the cascade-connected synthesis filter in the synthesis filter part 500, outputting a synthesized acoustic signal of the selected synthesis filter.

Figure 7:
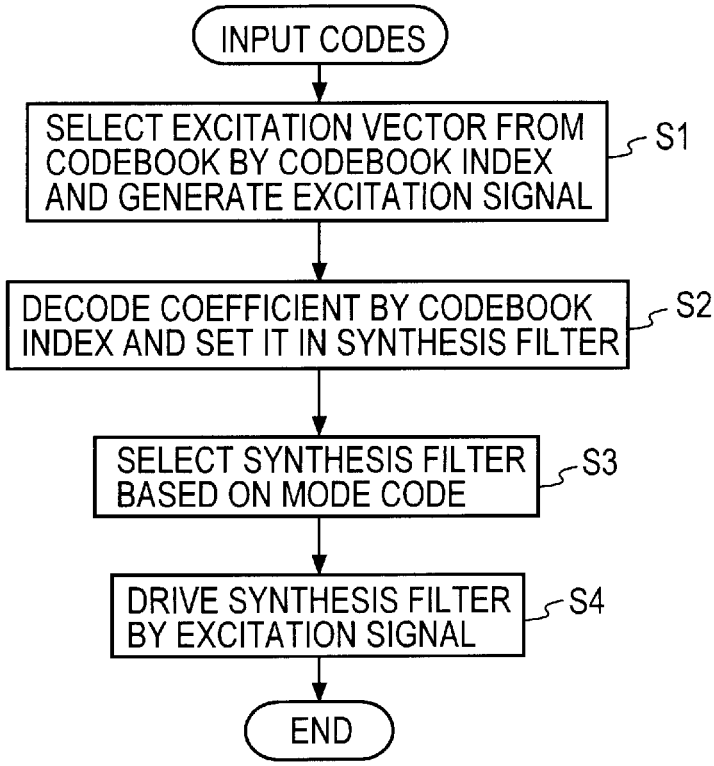
FIG. 7 is a flowchart showing the decoding procedure by the decoding apparatus of FIG. 6.

FIG. 7 is a flowchart showing the decoding procedure according to the present invention.

Step S1: Upon input of codebook indices into the decoding apparatus, the excitation signal generating part 300 selects from its codebooks the excitation vector and the gain vector corresponding to the input codebook indices, and generates an excitation signal in the same manner as described previously with reference to FIG. 2.

Step S2: The coefficients setting part 320 decodes the input codebook indices to obtain LP coefficients, and/or performs the LPC analysis and/or inverse filtering of the previous synthesized acoustic signal to obtain low-order and/or high-order filter coefficients, and sets them in the low-order synthesis filter (33) and the cascade-connected synthesis filter (59) in the synthesis filter part 500.

Step S3: The mode select part 51 responds to the input mode code to control a switch (S3) in the synthesis filter part 500 to select the low-order synthesis filter (33) or cascade-connected synthesis filter (59).

Step S4: The excitation signal is applied from the excitation signal generating part 300 to the selected one of the synthesis filters in the synthesis filter part 500 to drive it to generate a synthesized acoustic signal.

FIG. 8 illustrates in block form the functional configuration of an embodiment of the coding apparatus according to the present invention. In this embodiment a cascade-connected synthesis filter 29, formed by a cascade connection of high- and low-order LP synthesis filters 29*a* and 29*b* as disclosed in the afore-mentioned Japanese patent application laid-open gazette and Literature 1, is provided in combination with the LP synthesis filter 14 in the conventional coding system of FIG. 1. The input acoustic signal of the current frame from the input terminal 11 is provided first to the LPC analysis part 12, which performs an LPC analysis of the input signal to obtain p-th order LP coefficients $\hat{\alpha}_i$, where i=1, . . . ,p. The LP coefficients $\hat{\alpha}_i$ are quantized in the quantization part 13, and the quantized LP coefficients $\alpha_I$, where i=1, . . . ,p, are set as filter coefficients in the p-th order LP synthesis filter 14 whose transfer function is expressed by Equation (1). The synthesis filter 14 may be same as that 14 in FIG. 1, and its linear prediction order p is set in the range from 10 to 20. Next, a previous synthesized signal or signals (of one to several immediately preceding frames) from a synthesized signal buffer 25 are subjected to an LPC analysis in an LPC analysis part 26 to obtain p'-th order LP coefficients $\alpha'_k$, where k=1, . . . , p'. The prediction order p' may be equal to or slightly differ from p. In the LPC analysis, the window for multiplying the signal sequence to be analyzed may be either an asymmetrical window or a symmetrical window like a Hamming window.

Then, in a p'-th order LP inverse filter 27 which uses the LP coefficients $\alpha'_k$ as its filter coefficients and whose transfer function is expressed by the following equation:

$$A'(z) = 1 + \sum_{k=1}^{p'} \alpha'_k z^{-k} \tag{2}$$

the synthesized signals of the one or more immediately preceding frames are subjected to inverse filtering to obtain residual signals. At this time, $\alpha_i$ may be used as a substitute for $\alpha'_k$.

Following this, the residual signals of the previous synthesized signals are subjected to LPC analysis in an LPC analysis part 28 to obtain n-th order LP coefficients $\beta_j$, where j=1, . . . , n. In order that the fine spectral structure, which cannot be predicted by the p'-th order linear prediction in the LPC analysis part 28, may be expressed by the n-th order linear prediction, it is desirable that the linear prediction order n be sufficiently larger than at least twice p' or p. For example, when a music signal is to be encoded, a 100th or higher order prediction may sometimes be needed.

Then, the coefficients $\alpha'_k$ and $\beta_j$ thus obtained are used to form the p'-th order synthesis filter (a low-order synthesis filter) 29*a* and the n-th order synthesis filter (a high-order synthesis filter) 29*b* whose transfer functoins are expressed by the following Equations (3) and (4):

$$\frac{1}{A'(z)} = \frac{1}{1 + \sum_{k=1}^{p'} \alpha'_k z^{-k}} \tag{3}$$

$$\frac{1}{B(z)} = \frac{1}{1 + \sum_{j=1}^{n} \beta_j z^{-j}} \tag{4}$$

The n'-th order synthesis filter 29*a* and the n-th order synthesis filter 29*b* are cascade-connected to form the cascade-connected synthesis filter 29 whose transfer function is expressed by the following Equation (5).

$$H(z) = \frac{1}{A'(z)} \cdot \frac{1}{B(z)} = \frac{1}{1 + \sum_{k=1}^{n} \alpha'_k z^{-k}} \cdot \frac{1}{1 + \sum_{j=1}^{n} \beta_j z^{-j}} \tag{5}$$

At this time, $\alpha'_k$ may be substituted with $\alpha_I$ as in the step of inverse filtering expressed by Equation (2).

The excitation signal from the adder 18 is applied to the synthesis filters 14 and 29. Based on the input acoustic signal of the current frame provided to the input terminal 11, it is decided in a mode decision part (a mode discriminator) 41 described later on which of the synthesis filter 14 and the cascade-connected synthesis filter 29 is to be selected, and according to the result of decision a switch SW is controlled to connect the output of the selected synthesis filter 14 or 29 to the subtractor 19.

The outputs provided as the result of the above coding procedure are the pitch index selected from the adaptive codebook 15, the index selected from the fixed codebook 21, the gain index from the gain codebook 17, the LP coefficient code from the quantization part 13 and the mode code selected by the mode discriminator 41. Incidentally, the switch SW merely symbolizes the selection of the synthesis filter 14 or 29 that provides higher quality coding of the input acoustic signal. In the actual processing, upon determination of the optimum set of indices, the selected synthesis filter, for example, 14 is driven by the excitation signal to determine its internal state. Then the resulting synthesized signal is applied to the unselected synthesis filter, for example, 29 inversely from its output side (inverse filtering) to determine its internal state. At this time, the switch SW connects the output side of the LP synthesis filter 14 to the output side of the cascade-connected synthesis filter 29. As a result, the internal states of the both synthesis filters 14 and 29 are updated. When the synthesis filter 29 is selected, too, the both synthesis filters 14 and 29 are similarly updated. During the search of the codebooks 15, 21 and 17 for optimum indices, only the selected synthesis filter 14 or 29 is operated.

In the embodiment of FIG. 8 the switch SW is shown to be placed at the input side of the subtractor 19, but it may be disposed at the output side of the subtractor 19. Further, instead of setting the perceptual weighting filter 20 at the output side of the subtractor 19, it is possible to place perceptual weighting filters $\mathbf{20}_1$ and $\mathbf{20}_2$ at two input sides of the subtractor 19 as indicated by the broken lines so that the input acoustic signal and the synthesized signal are provided to the subtractor 19 after being perceptually weighted.

Next, a description will be given of the principle of operation of the mode discriminator 41. In FIG. 8 the LP coefficients $\alpha_i$ which are provided to the LP synthesis filter 14 provide the input excitation signal with the spectral envelope of the input acoustic signal. If the LP coefficients $\alpha_i$ are set in an inverse filter of a characteristic inverse to that of the LP synthesis filter 14 to perform inverse filtering of the synthesized acoustic signal, a spectral-envelope flattened version of the synthesized acoustic signal is provided as residual signal. This residual signal represents the input excitation signal to the synthesis filter 14 having created the synthesized acoustic signal. The small power of the residual signal means that the coding efficiency for the input acoustic signal in the LP coefficients $\alpha_i$ set in the LP synthesis filter 14 is large accordingly—this means higher quality audio coding. The same is true of the cascade-connected synthesis filter 29 as well.

In view of the above, according to the present invention, the LP coefficients provided to the synthesis filters 14 and 29 in the current frame and their internal states updated in the previous frame are set in two inverse filters provided in the mode discriminator 41, then the synthesis acoustic signal estimated from the input acoustic signal is subjected to inverse filtering processes corresponding to the synthesis filters 14 and 29, respectively, to obtain residual signals as estimated input excitation signals thereto, and the powers of the residual signals are compared to decide which synthesis filter is to be used to perform higher quality audio coding.

It must be noted here that the decision in the present invention is made, for each input signal frame, not as to whether the input acoustic signal is a music or speech signal but as to which of the cascade-connected synthesis filter 29 and the low-order synthesis filter 14 is to be used for higher quality audio coding. When the low-order synthesis filter 14 is selected based on the result of decision, the frequency with which the input acoustic signal frame is a speech signal frame is high, whereas when the cascade-connected synthesis filter 29 is selected, the frequency with which the input acoustic signal frame is a music signal frame is high. However, situations can also arise where the cascade-connected synthesis filter is selected in the speech signal frame and where the low-order synthesis filter 14 is selected in the music signal frame. Besides, in the present invention the input acoustic signal is not limited specifically to music and speech signals, but either one of the synthesis filters is selected for high quality coding of an arbitrary audio signal.

FIG. 9 is a block diagram depicting a concrete example of the mode decision part 41 in FIG. 8. The mode decision part 41 of FIG. 9 comprises: an LP inverse filter 41A of an inverse characteristic to the LP synthesis filter (low-order synthesis filter) 14; an LP inverse filter 41B of an inverse characteristic to the cascade-connected synthesis filter 29; and a comparator 41C which is supplied with output residual signals $e_1$ and $e_2$ of the inverse filters 41A and 41B and decides which of the synthesis filters 14 and 29 will provide higher quality coding of the input signal. Based on the result of decision by the comparator 41C, the switch SW is controlled. The audio coding qualities for the input acoustic signal by the low-order synthesis filter 14 and by the cascade-connected synthesis filter 29 can be estimated from the input acoustic signal even without performing a trial of audio coding for the current frame through the use of each of the synthesis filters 14 and 29, which requires a great deal of computational complexity. The decision is made by comparing the powers of the residual signals (corresponding to the estimated input excitation signals to the synthesis filters 14 and 29) obtained by inverse filtering on the estimated synthesized signals by the inverse filters 41A and 41B of inverse characteristics to the synthesis filters 14 and 29, respectively. The concrete example of the mode decision part 41 will be described below.

The mode decision part 41 is supplied with: the input acoustic signal from the input terminal 11; the p-th order filter coefficients $\alpha_i$ that are used in the synthesis filter 14 in the current frame; the internal state (the state updated by the previous frame processing) of the synthesis filter 14 at the start of the current frame processing; the p'-th order filter coefficients $\alpha'_k$ (where k=1,2, . . . ,p') and the n-th order filter coefficients $\beta_j$ (where j=1,2, . . . ,n) for the cascade-connected synthesis filter 29; and the internal state of the synthesis filter 29 at the start of the current frame processing. In the FIG. 9 embodiment, the input acoustic signal is used as an estimated synthesized signal on the assumption that the output error signal from the subtractor 19 is zero, that is, that the input acoustic signal is approximates equal to the synthesized signal. The LP inverse filter 41A uses, as its filter coefficients, the filter coefficients $\alpha_i$ of the LP synthesis filter 14 and has the transfer function expressed by the following equation:

$$A(z) = 1 + \sum_{i=1}^{p} \alpha_i z^{-i} \tag{6}$$

The inverse filter 41A performs inverse filtering of the estimated synthesized signal (the input acoustic signal) of the current frame to obtain the residual signal $e_1$. In this inverse filtering, the inverse filter 41A is initialized to its internal state at the time of having performed the previous frame processing by the LP synthesis filter 14.

The LP inverse filter 41B uses, as its filter coefficients, the filter coefficients $\alpha'_k$ and $\beta_j$ of the LP synthesis filters 29*a* and 29*b* and has the transfer function expressed by the following equation.

$$A'(z)B(z) = \left(1 + \sum_{k=1}^{p'} \alpha'_k z^{-k}\right)\left(1 + \sum_{j=1}^{n} \beta_j z^{-j}\right) \tag{7}$$

The inverse filter 41B performs inverse filtering of the estimated synthesized signal (input acoustic signal) of the current frame to obtain the residual signal $e_2$. In this inverse filtering, the LP synthesis filter 41B is initialized to its internal state at the time of having performed the previous frame processing by the cascade-connected synthesis filter 29.

The comparator 41C compares the powers $\|e_1\|^2$ and $\|e_2\|^2$ of the thus obtained residual signals $e_1$ and $e_2$, and controls the switch SW to select the synthesis filter 14 or 29 which has the filter coefficients of the inverse filter 41A or 41B having output the residual signal of the smaller power. Incidentally, by initializing the internal state of each of the inverse filters 41A and 41B as described above, the residual signal $e_1$ and $e_2$ corresponding to an ideal excitation signal are obtained for the input acoustic signal in the coding system.

In this case, the adaptive addition of variable weighting factors $W_1$ and $W_2$ to the powers of the residual signals, like $\|W_1e_1\|^2$ and $\|W_2e_2\|^2$, permits more judicious selection of the synthesis filter for each frame and prevents a feeling of discontinuity which would otherwise be caused by frequent switching between the two synthesis filters for each selected frame. For example, when $e_1<e_2$ and the filter 14 is selected in some frame, the power $e_1$ is multiplied by the weighting factor $W_1$ set at $0<W_1<1$, and/or $e_2$ is multiplied by $W_2$ set at $W_2>1$; thereafter, when $\|W_1e_1\|^2>\|W_2e_2\|^2$ and the filter 29 is selected, $W_1$ is set to $W_1>1$ and $W_2$ to $0<W_2<1$.

Figure 10:
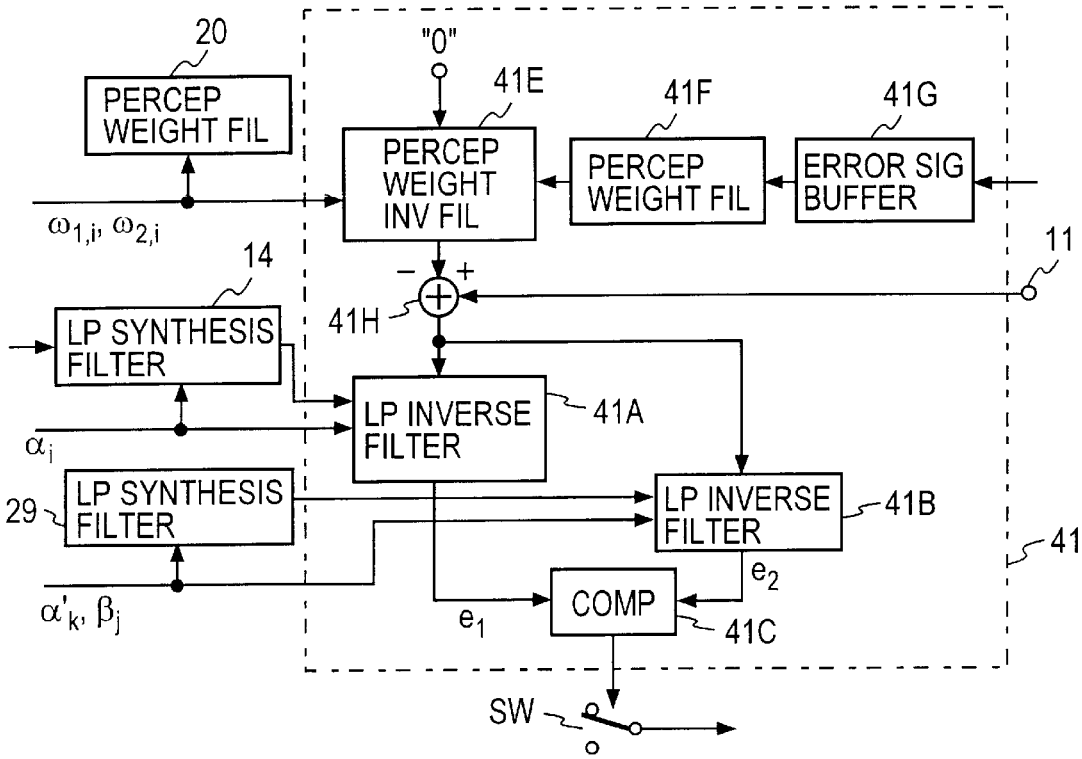
FIG. 10 is a block diagram depicting another example of the configuration of the mode discriminator 41.

The FIG. 9 embodiment has been described above on the assumption that the output error signal from the subtractor 19 in FIG. 8 is substantially zero; the input acoustic signal to the terminal 11 is used as an estimated synthesized signal and processed by the inverse filters 41A and 41B to provide the residual signals $e_1$ and $e_2$ corresponding to the estimated input excitation signals to the synthesis filters 14 and 29. However, the coding system in the coding apparatus of FIG. 8 uses the perceptually weighted residual signal to control the search of the codebooks 14, 21 and 17. Accordingly, it is preferable that the mode decision part 41 also make the decision using ideal residual signals $e_1$ and $e_2$ which enable the perceptually weighted input acoustic signal to be reconstructed. FIG. 10 depicts a modified form of the mode decision part 41 adapted to comply with such a requirement. In FIG. 10 the synthesized signal is estimated on the assumption that the output signal level from the perceptual weighting filter 20 is substantially zero, that is, taking into account the operation of the filter 20 as well, and the estimated synthesized signal is subjected to inverse filtering by the inverse filters 41A and 41B to obtain residual signals.

In the mode decision part 41 of FIG. 10 a perceptual weighting inverse filter 41E is provided, in which coefficients $\omega_{1,i}$ and $\omega_{2,i}$ of the perceptual weighting filter 20 that has the transfer function expressed by the following equation:

$$W(z) = \frac{1 + \sum_{i=1}^{q} \omega_{2,i} z^{-i}}{1 + \sum_{i=1}^{q} \omega_{1,i} z^{-i}} \quad (8)$$

And the output from the subtractor 19 in the previous frame stored in an error signal buffer 41G is perceptually weighted by a perceptual weighting filter 41F, and the internal state of the filter 41F at that time is set as the initial state in the inverse filter 41E. The perceptual weighting inverse filter 41E has set therein the filter coefficients $\omega_{1,i}$ and $\omega_{2i}$ and has the transfer function expressed by the following Equation (9) but inverse to the characteristic expressed by Equation (8):

$$W^{-1}(z) = \frac{1 + \sum_{i=1}^{q} \omega_{1,i} z^{-i}}{1 + \sum_{i=1}^{q} \omega_{2,i} z^{-i}} \quad (9)$$

By inputting a "0" into the inverse filter 41E to perform inverse filtering, the input to the filter 20 (that is, the output error signal from the subtractor 19) is estimated, and the estimated error signal is subtracted by a subtractor 41H from the input acoustic signal fed from the input terminal 11, thereby estimating the synthesized signal which is applied to the subtractor 19. It is common to the FIG. 4 embodiment to apply the estimated synthesized signal to the inverse filters 41A and 41B to provide the residual signals $e_1$ and $e_2$.

The mode decision part 41 of either FIG. 9 or 10 can be applied to the embodiment of FIG. 8 regardless of whether the perceptual weighting filter is implemented as the filter 20 at the output side of the subtractor 19 or as the filters $\mathbf{20}_1$ and $\mathbf{20}_2$ at the input sides of the subtractor 19. The same can apply to all the embodiments described hereinafter.

Figure 11:
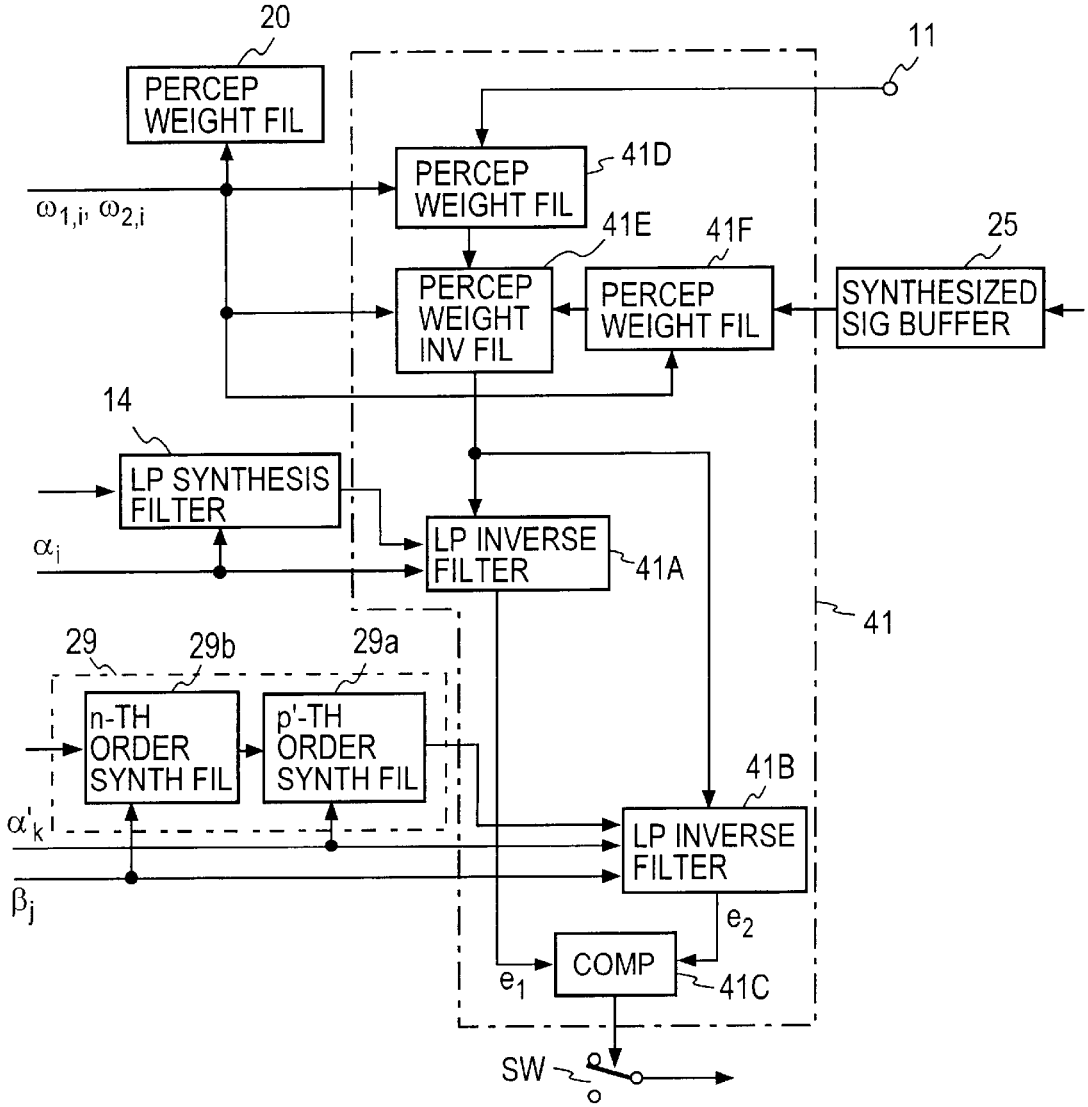
FIG. 11 is a block diagram depicting a modified form of the mode discriminator 41.

In the FIG. 8 embodiment the perceptual weighting of the output error signal from the subtractor 19 by the perceptual weighting filter 20 is followed by the search of the codebooks 15, 21 and 17 for indices that will minimize the power of the weighted error signal. This is equivalent to the connection of the perceptual weighting filters $\mathbf{20}_1$ and $\mathbf{20}_1$ to the two inputs of the subtractor 19 as indicted by the broken-line blocks in FIG. 8. That is, the same result could be obtained even by applying the input acoustic signal from the input terminal 11 and the synthesized signal from the synthesis filter 14 or 29 to the subtractor 19 after processing them by the perceptual weighting filter 20. FIG. 11 depicts an example of the configuration of the mode decision part 41 designed from this point of view. In the illustrated example the error is calculated between the input acoustic signal and the synthesized signal both assumed to have been perceptually weighted, and the synthesized signal is estimated on the assumption that the power of the error signal is "0."

The mode decision part 41 of FIG. 11 has a perceptual weighting filter 41D for perceptual weighting of the input acoustic signal, the perceptual weighting inverse filter 41E for estimating the synthesized signal from the perceptually weighted input acoustic signal by its inverse filtering, and the perceptual weighting filter 41F for initializing the internal state of the perceptual weighting inverse filter 41E. The estimated synthesized signal generated by the perceptual weighting inverse filter 41E is applied to the inverse filters 41A and 41B to obtain the residual signals as in the case of FIG. 9.

The q-th order filter coefficients $\omega_{1,i}$ and $\omega_{2,i}$ which are used in the perceptual weighting filter 20 are provided as filter coefficients to the perceptual weighting filters 41D, 41F and the perceptual weighting inverse filter 41E. As is the case with the FIG. 9 embodiment, the p-th order filter coefficients $\alpha_i$ which is used in the synthesis filter 14 and the internal state of the filter 14 at the beginning of the current frame are set in the LP inverse filter 41A, and the p'-th filter coefficients $\alpha'_k$ and n-th order filter coefficients $\beta_j$ which are used in the cascade-connected synthesis filter 29 and the internal state of the filter 29 at the beginning of the current frame are set in the LP inverse filter 41B. The perceptual weighting filter 41D is provided corresponding to the virtually provided perceptual weighting filter $\mathbf{20}_1$, and based on the filter coefficients $\omega_{1,i}$ and $\omega_{2,i}$ set therein, it has the transfer function given by Equation (8) and performs perceptual weighting of the input acoustic signal. By this filtering, the perceptually weighted input acoustic signal is estimated which is provided from the virtually inserted perceptual weighting filter $\mathbf{20}_1$. The perceptual weighting filter 41F also has the transfer function given by Equation (8).

Based on the filter coefficients $\omega_{1,i}$ and $\omega_{2,i}$ set therein, the perceptual weighting inverse filter 41E has the transfer function given by Equation (9) and performs inverse filtering of the perceptually weighted input acoustic signal to create an estimated synthesized signal on the input side of the virtually inserted perceptual weighting filter $\mathbf{20}_2$. In this inverse filtering, the internal state of the inverse filter 41E is set to its internal state at the time the perceptual weighting filter 41F performed filtering of a synthesized signal of one or more immediately preceding frames provided from the synthesized signal buffer 25. The estimated synthesized signal thus obtained is inverse filtered by the inverse filters 41A and 41B to obtain the residual signals $e_1$ and $e_2$, and one of the synthesis filters is selected through the same procedure as described previously with reference to FIG. 9.

While in the above the estimated synthesized signal has been described to be generated on the assumption that the perceptual weighting filter 20 in FIG. 8 is virtually provided at the input side of the subtractor 19, the mode decision part 41 of FIG. 11 can also be used when the perceptual weighting filter 20 is substituted with the perceptual weighting filters $\mathbf{20}_1$ and $\mathbf{20}_2$ indicated by the broken-line blocks in FIG. 8. In such a case, however, since the filter coefficients and internal state of the perceptual weighting filter $\mathbf{20}_1$ for the input acoustic signal are set in the perceptual weighting filter 41D and since the filter coefficients and internal state of the perceptual weighting filter $\mathbf{20}_2$ for the synthesized signal are set in the perceptual weighting inverse filter 41E, the perceptual weighting filter 41F is unnecessary. Furthermore, if the perceptual weighting filter $\mathbf{20}_1$ is disposed closer to input terminal 11 than the mode decision part 41, the output from the filter $\mathbf{20}_1$ needs only to be fed into the perceptual weighting inverse filter 41E, and accordingly the perceptual weighting filter 41D can also be dispensed with.

Figure 12:
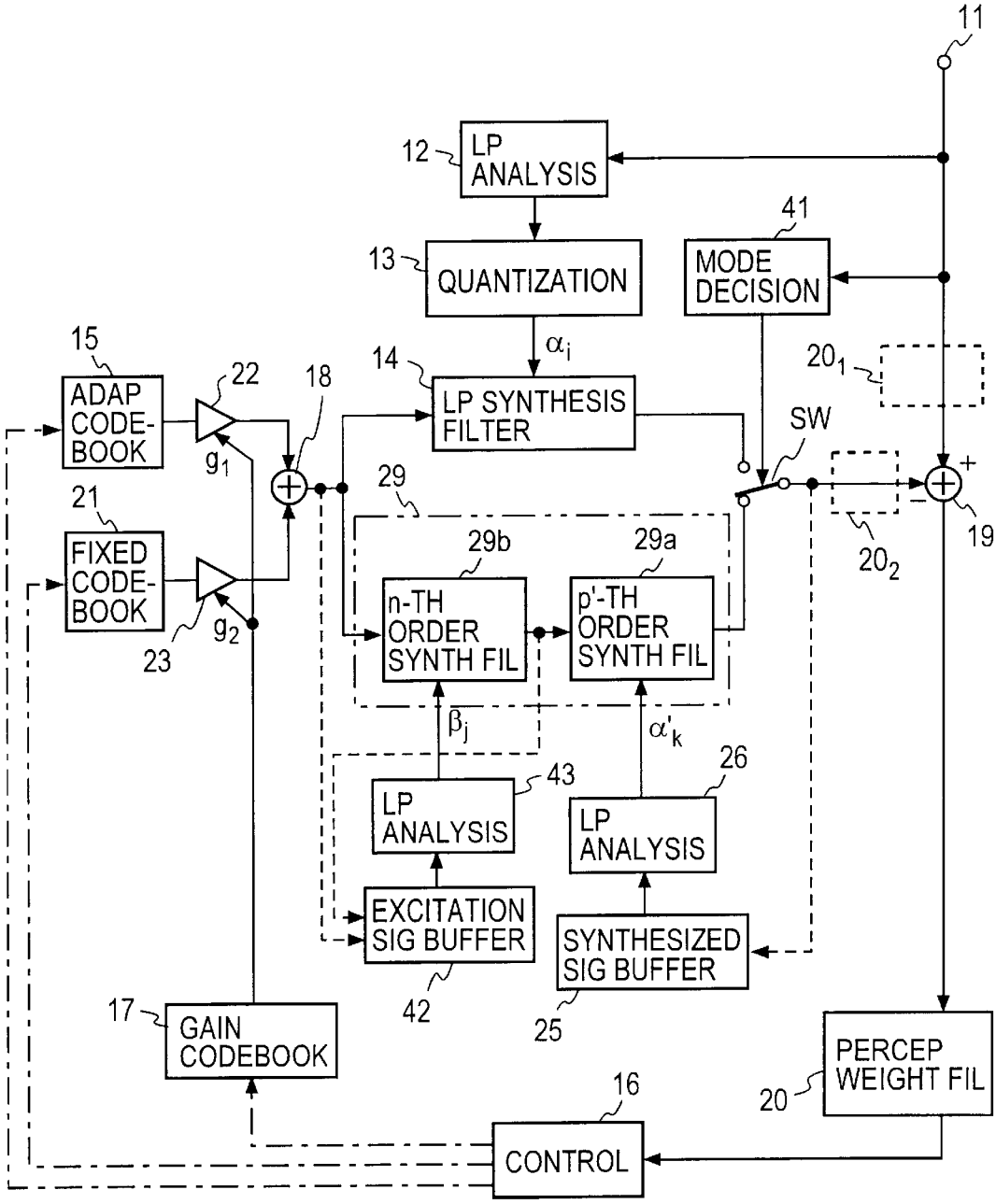
FIG. 12 is a block diagram illustrating the functional configuration of another embodiment of the coding apparatus according to the present invention.

FIG. 12 is a block diagram illustrating another embodiment of the coding apparatus according to the present invention. This embodiment differs from the FIG. 8 embodiment in that the n-th order LP coefficients $\beta_j$ are obtained by performing an n-th order LPC analysis on the previous excitation signal from an excitation signal buffer 42 in an LPC analysis part 43. The respective signals are stored in the buffers 25 and 42 when indices to be selected from the codebooks 14 and 17 and the gain $g_1$ and $g_2$ to be provided to the multipliers 22 and 23 have been determined. The excitation signal buffer 42 is supplied with the output signal from the adder 18 or the n-th order synthesis filter 29*b*, depending on whether the LP synthesis filter 29 or cascade-connected synthesis filter 29 has been selected. In this embodiment the mode decision part 41 may be any of those depicted in FIGS. 9, 10 and 11.

Figure 13:
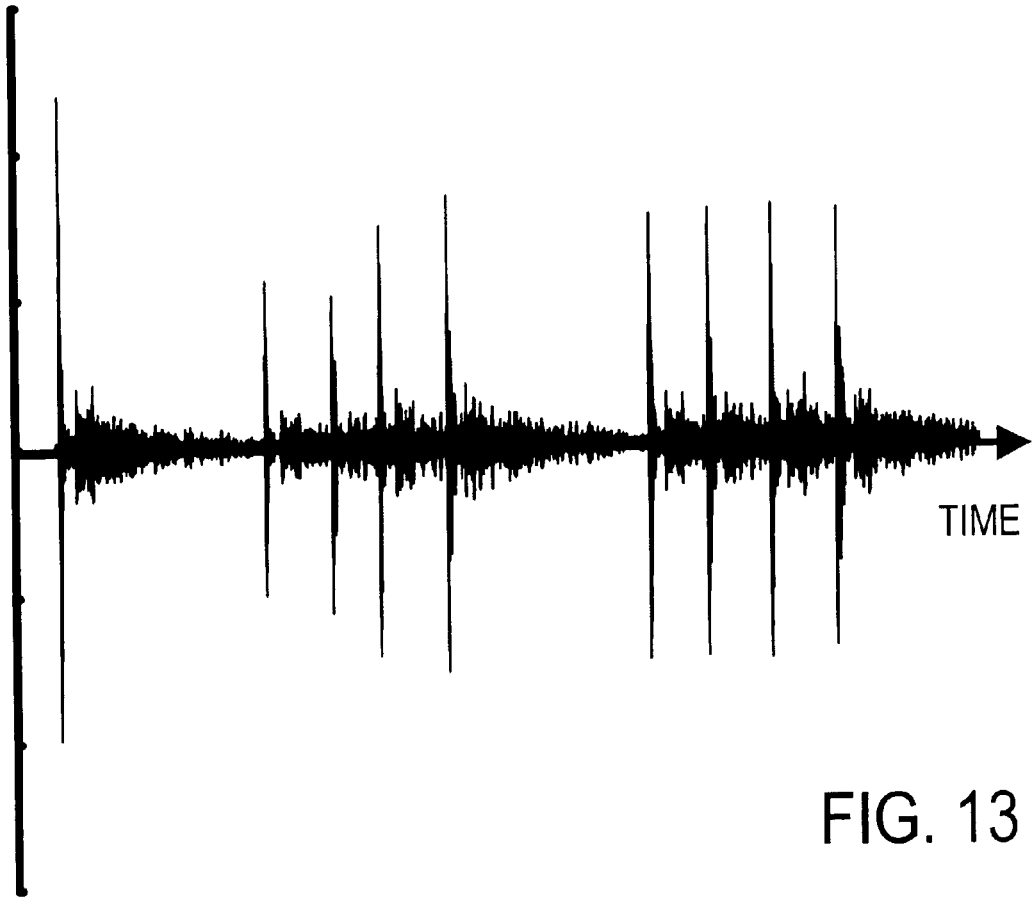
FIG. 13 is a graph showing an example of the waveform of a signal which sharply changes with time.
Figure 14:
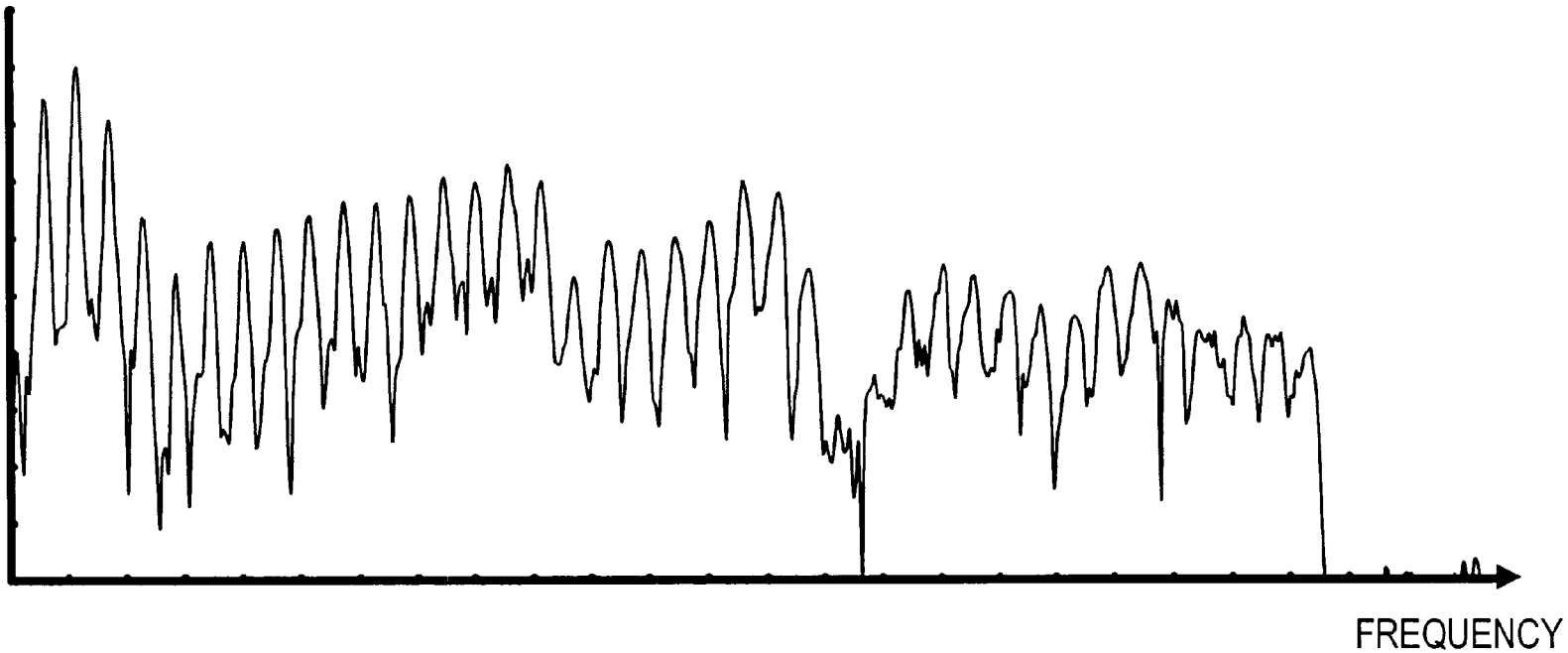
FIG. 14 is a graph showing an example of a typical power spectrum of a speech signal.
Figure 15:
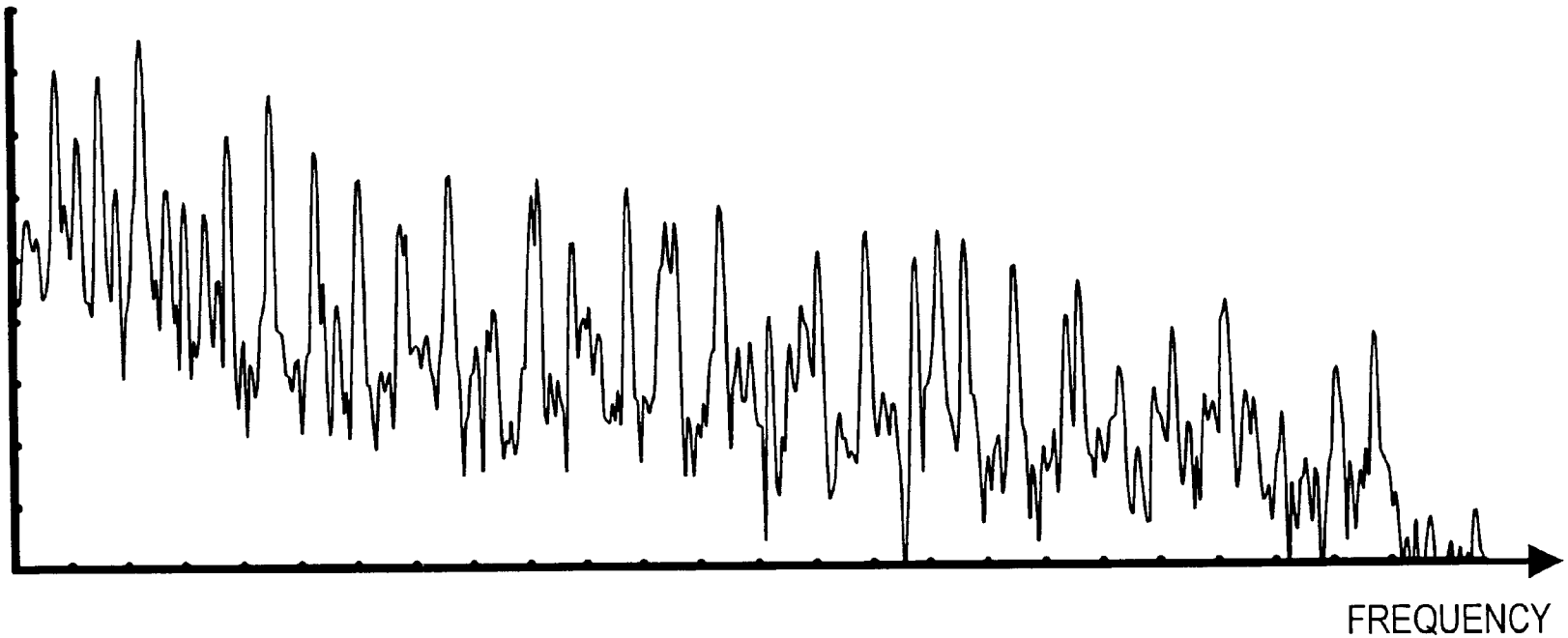
FIG. 15 is a graph showing an example of a typical power spectrum of a music signal.

As depicted in FIGS. 8 and 12, according to the coding apparatus of the present invention, in the case where the waveform of the input acoustic signal undergoes substantial variations with time (in the case of a castanets sound, for instance) as depicted in FIG. 13, or where the frequency characteristic of the input acoustic signal is formed by harmonics of a single-pitch frequency characteristic of speech and the pitch lag undergoes short-term variations as depicted in FIG. 14, the low-order synthesis filter 14 is selected which expresses the spectral envelope of the input acoustic signal. In the case where the frequency characteristic of the input acoustic signal is formed by a plurality of unevenly-spaced sharp peaks as shown in FIG. 15, the cascade-connected synthesis filter 29 is selected which is capable of expressing the spectral envelope and fine spectral structure of the input acoustic signal. In this way, the optimum audio coding can be achieved.

Incidentally, the perceptual weighting filters are not limited specifically to the auto-regressive, moving-average type expressed by Equation (8).

Figure 16:
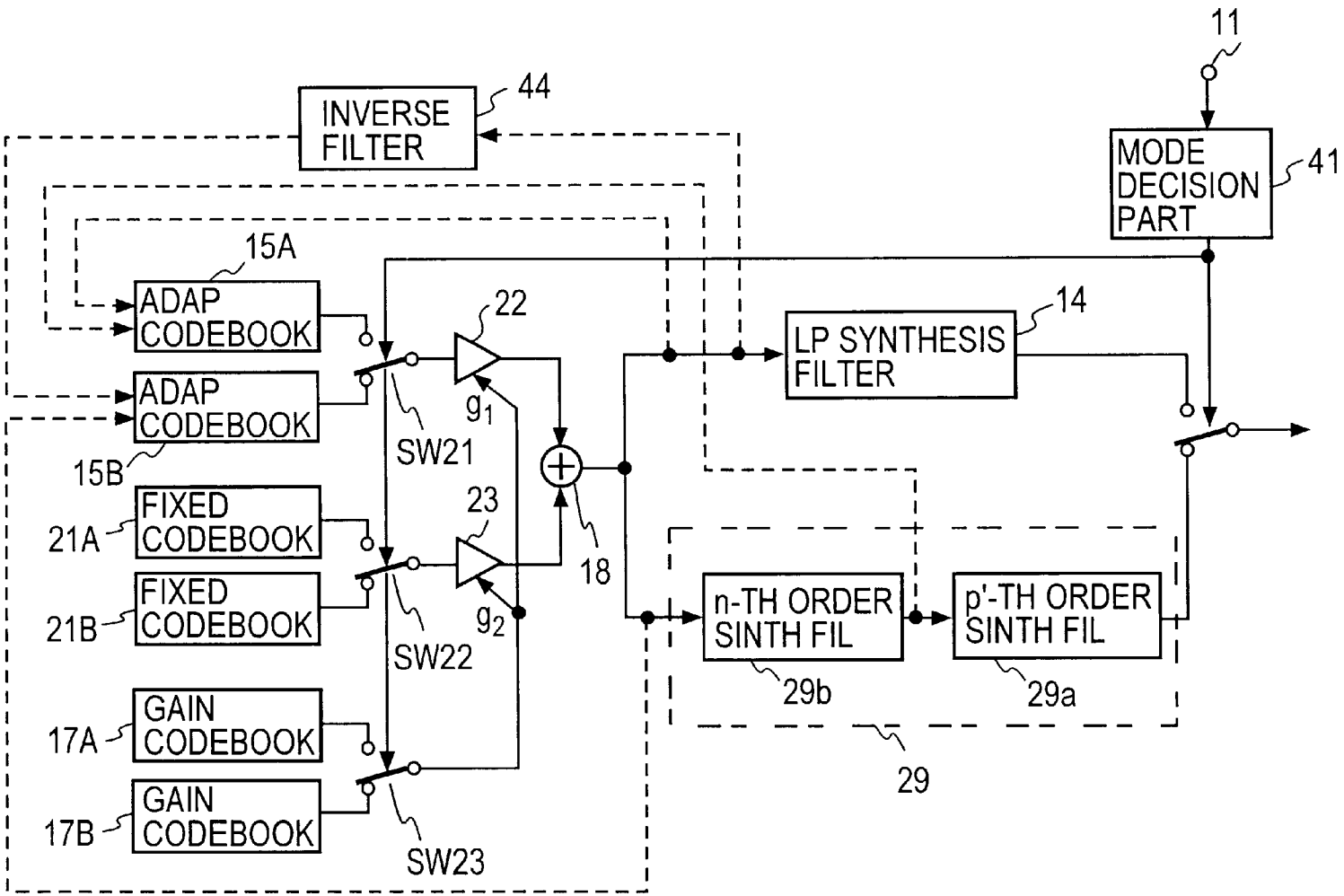
FIG. 16 is a block diagram depicting the functional configuration of the principal part of another embodiment of the present invention adapted to select a codebook in accordance with the selection of the synthesis filter.

FIG. 16 illustrates in block form only a structure associated with a system in which adaptive codebooks 15A, 15B, fixed codebooks 21A, 21B and gain codebooks 17A, 17B are selectively used by changing over switches SW21, SW22 and SW23 in correspondence with the synthesis filter 14 or 29 selected in the mode decision part 41 in the embodiments of FIGS. 8 and 12. With such a configuration as shown, it is possible not only to selectively use the synthesis filters 14 and 29 in accordance with the characteristic of the input acoustic signal and to prepare the codebooks 15A, 15B, 21A, 21B, 27A and 17B that match the characteristic of the input acoustic signal. That is, the adaptive codebook 15A is updated by applying thereto the input excitation signal of the filter 14 when this filter is being selected, and when the p'-th order synthesis filter 29*a* in the filter 29 is being selected, the input excitation signal thereto is applied to the adaptive codebook 15A to update it. The adaptive codebook 15B is updated by applying thereto the input excitation signal of the filter 29 when this filter is being selected, and when the filter 14 is being selected, the input excitation signal thereto is applied via an n-th order LP inverse filter 44 to the adaptive codebook 15A to update it.

In the case of preparing the codebooks through training, the fixed codebook 21A is prepared using training data through the use of the synthesis filter 14, and the fixed codebook 21B is similarly prepared using training data through the use of the synthesis filter 29. The gain codebook 17A is prepared simultaneously with the preparation of the fixed codebook 21A, and the gain codebook 17B is prepared simultaneously with the preparation of the fixed codebook 21B.

Figure 17:
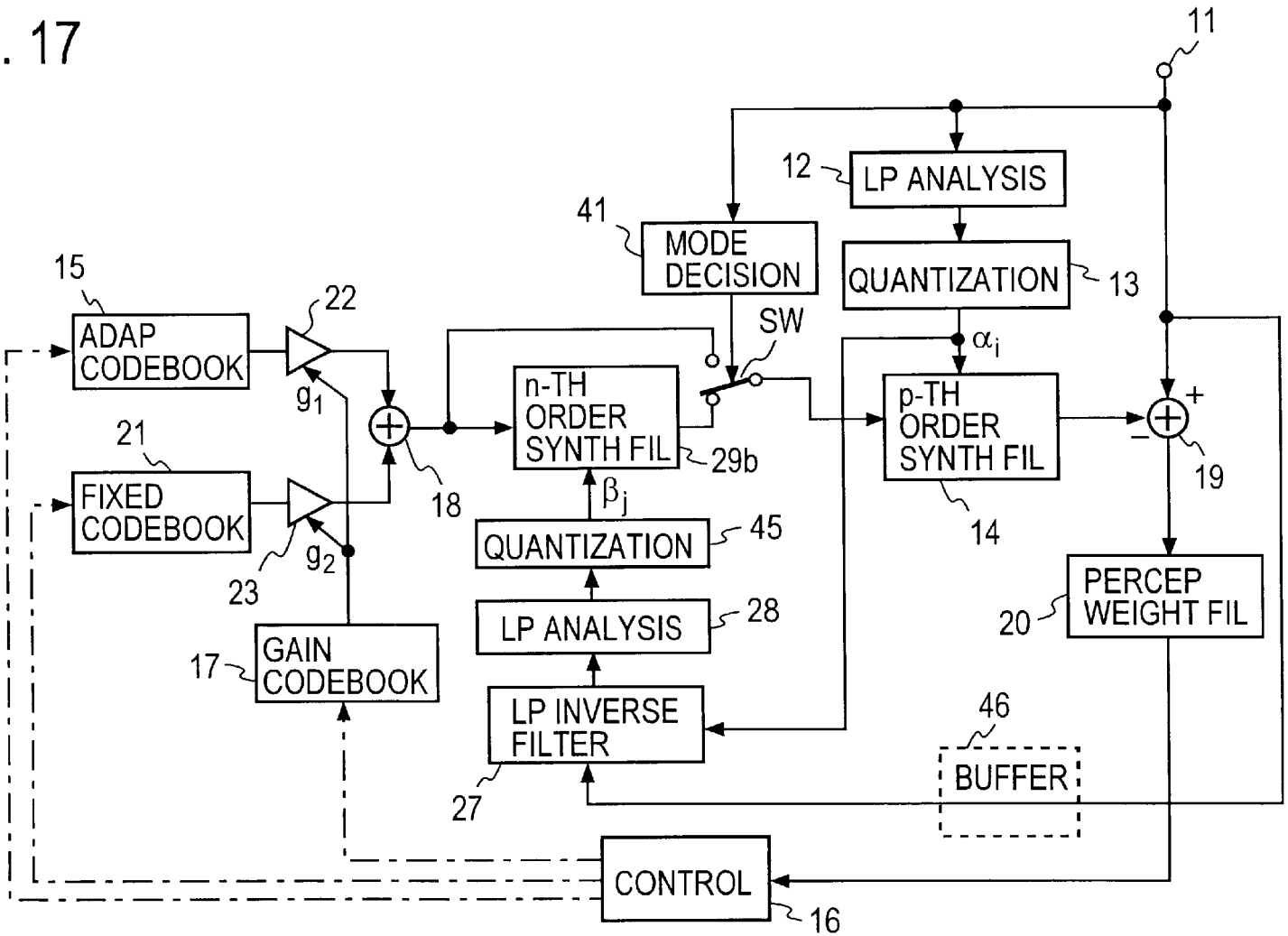
FIG. 17 is a block diagram depicting the functional configuration of another embodiment of the present invention in which part of a cascade-connected synthesis filter is used also as a synthesis filter to be switched therefrom.

As referred to previously, the p-th order synthesis filter 14 and the p'-th order synthesis filter 29*a* can share the same synthesis filter with each other. FIG. 17 depicts an example in which the synthesis filter 14 is used also as the synthesis filter 29, the parts corresponding to those in FIG. 8 being identified by the same reference numerals. In this embodiment the output of the adder 18 and the output of the n-th order synthesis filter 29*b* are selectively connected via the switch SW to the input of the p-th order synthesis filter 14. In the LP inverse filter 27 the p-th order LP coefficients $\alpha_i$ quantized in the quantization part 13 are set and the input acoustic signal from the input terminal 11 is subjected to LP inverse filtering. In this example, a buffer indicated by a broken-line block 56 may be provided so that the synthesis filter performs inverse filtering of input acoustic signals of several frames at one time. In this instance, the n-th order LP coefficients $\beta_j$, provided as the result of analysis by the LPC analysis part 28, are quantized in a quantization part 45, then the quantized LP coefficients $\beta_j$ are set in the n-th order filter 29*b*, and a code representing the n-th order quantized LP coefficients $\beta_j$ are added to the coded output.

Figure 18:
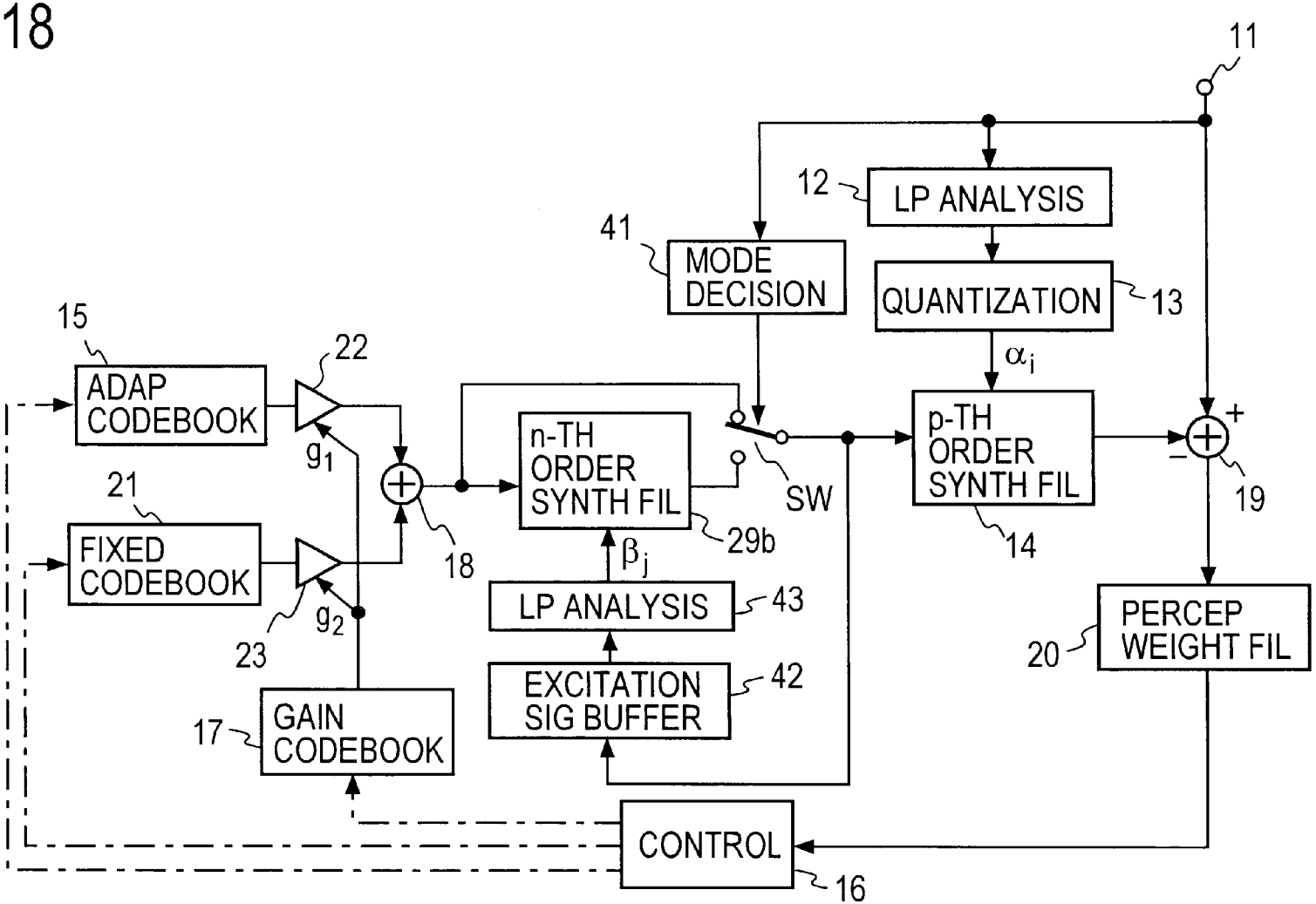
FIG. 18 is a block diagram depicting the functional configuration of another embodiment of the present invention in which part of a cascade-connected synthesis filter is used also as a synthesis filter to be switched therefrom.

FIG. 18 depicts an example in which the p-th order synthesis filter 14 is used as also the p'-th order synthesis filter 29*a*, the parts corresponding to those in FIG. 12 being identified by the same reference numerals. The p-th order synthesis filter 14, the n-th order synthesis filter 29*b* and the switch SW are connected in the same manner as in the FIG. 17 embodiment. The input to the excitation signal buffer 42 is the output signal from the switch SW.

Figure 19:
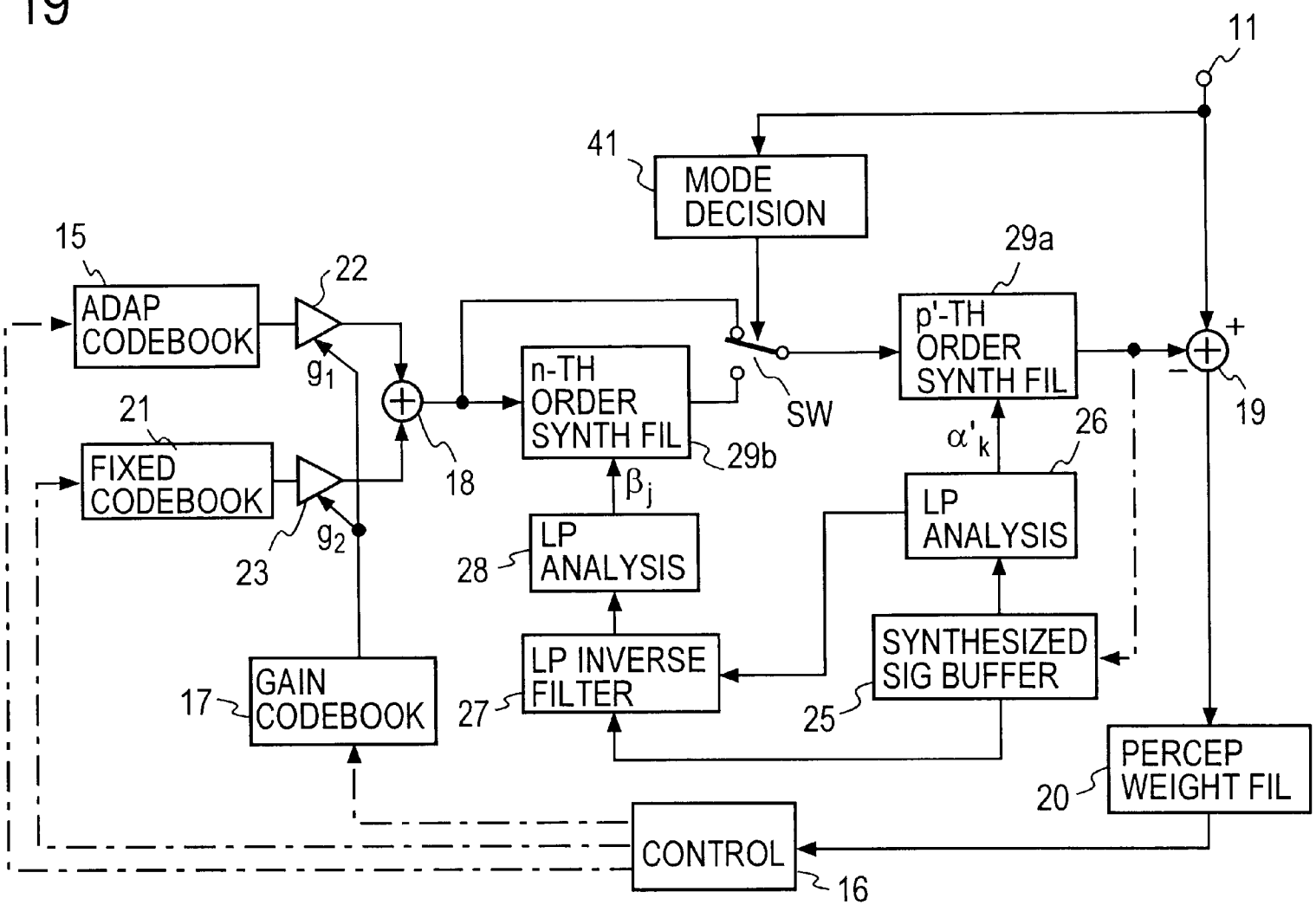
FIG. 19 is a block diagram depicting the functional configuration of another embodiment of the present invention in which part of a cascade-connected synthesis filter is used also as a synthesis filter to be switched therefrom.
Figure 20:
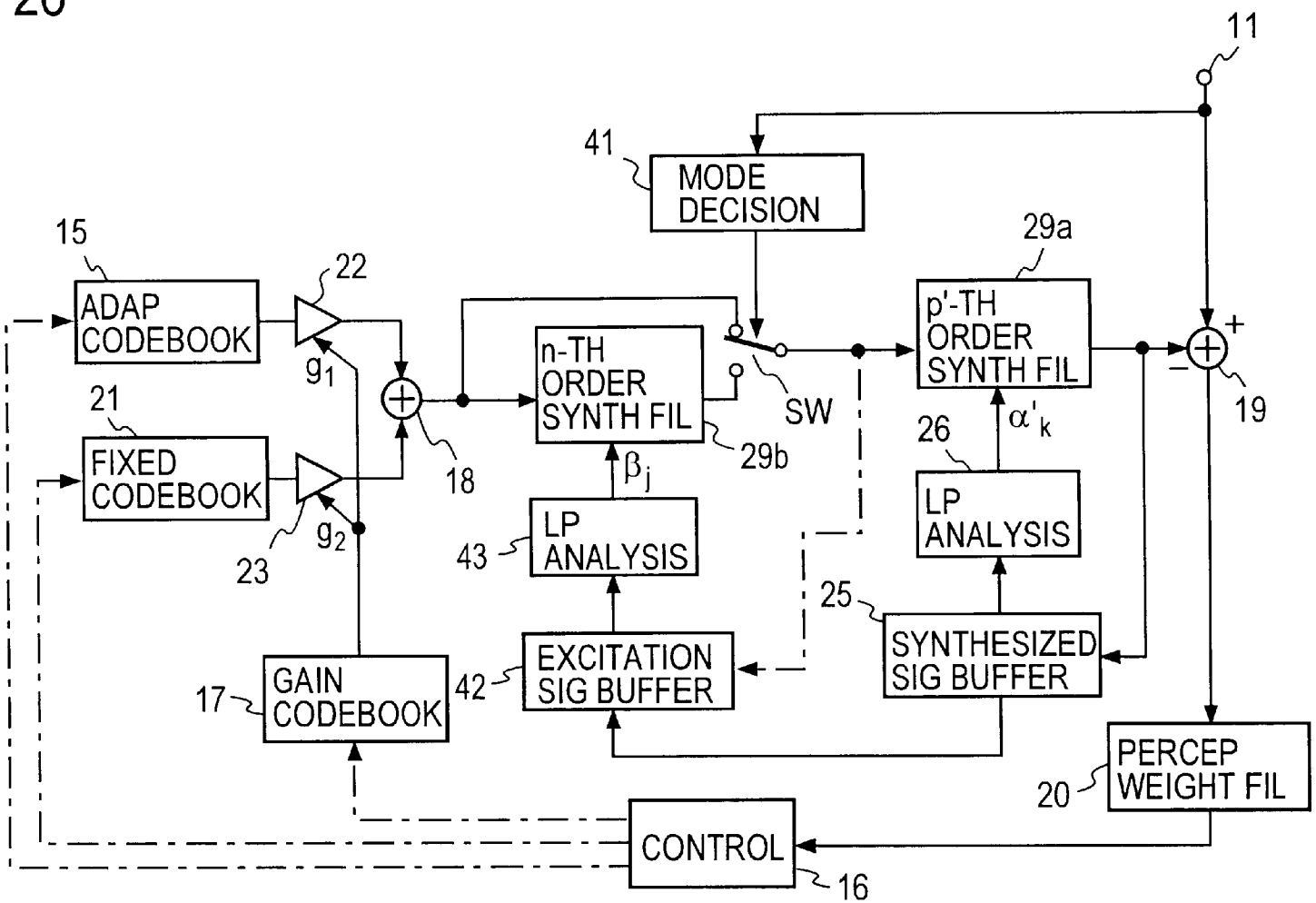
FIG. 20 is a block diagram depicting the functional configuration of still another embodiment of the present invention in which part of a cascade-connected synthesis filter is used also as a synthesis filter to be switched therefrom.

In FIG. 19 there is shown, as being applied to the FIG. 8 embodiment, an example in which the p'-th order synthesis filter 29*a* is used also as the p-th order synthesis filter 14 The p'-th order synthesis filter 29*a* is provided in place of the p-th order synthesis filter 14 in the FIG. 17 embodiment, and as is the case with the FIG. 8 embodiment, the synthesized signal is subjected to an LPC analysis in the LPC analysis part 26, and the resulting p'-th order LP coefficients are set in the p'-th order synthesis filter 29*a*. The LPC analysis part 12, the quantization part 13 and the LP synthesis filter 14 are omitted. In this instance, the code indicative of the LP coefficients $\alpha_i$ are not output.

In the FIG. 12 embodiment, too, the p-th order synthesis filter 14 can be used also as the p'-th order synthesis filter 29*a* as in the case of FIG. 19. FIG. 15 depicts such a modification. The p'-th order synthesis filter 29*a*, the n-th order synthesis filter 29*b* and the switch SW are connected in the same manner as shown in FIG. 8. It will easily be understood that the LP inverse filter 27 is omitted and that the output signal from the switch SW is provided via the excitation signal buffer 42 to an LPC analysis part 43 as required. In this instance, the LP coefficient code need not be output.

Figure 21:
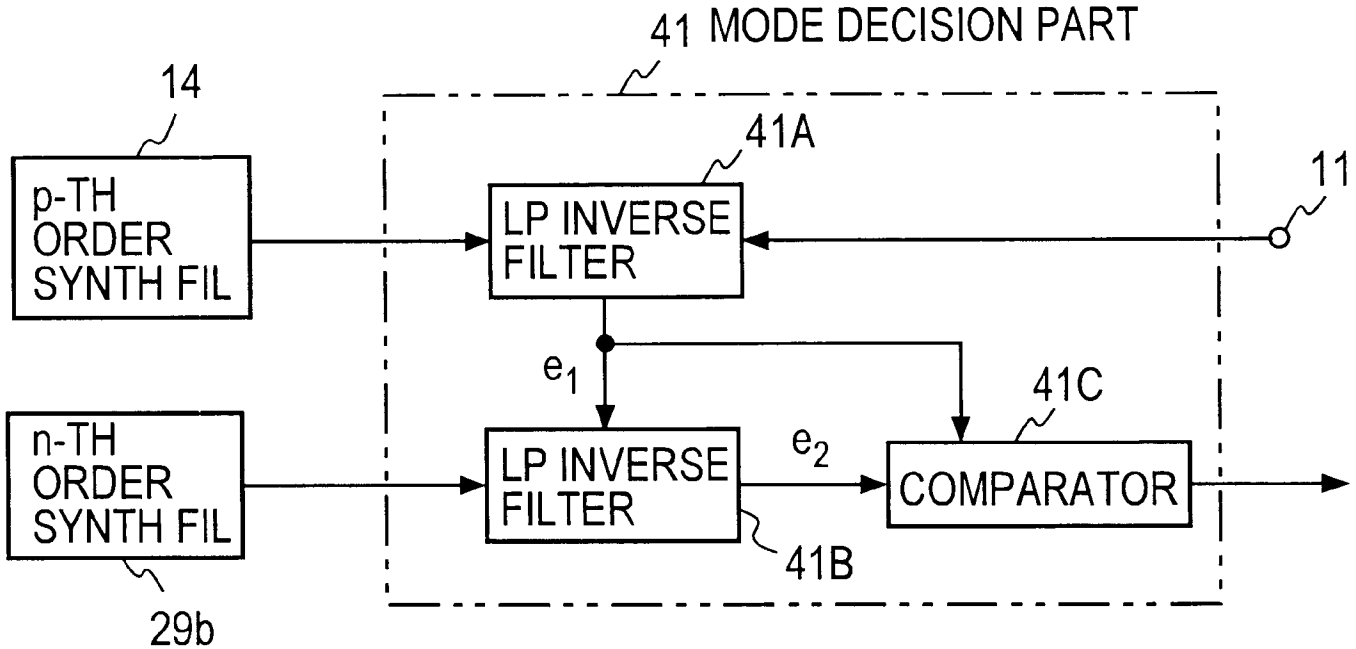
FIG. 21 is a block diagram illustrating still a further example of the mode discriminator 41.

FIG. 21 depicts in block form the mode decision part 41 which is used when the same synthesis filter is used both as the p-th order synthesis filter 14 and the p'-th order synthesis filter 29*a* as described above with reference to FIGS. 17 to 20. The input acoustic signal is subjected to LP inverse filtering by the LP inverse filter 41A having set therein the filter coefficients $\alpha_i$ (or $\alpha'_k$) and internal state of the p-th (or p'-th) order synthesis filter 14 (or 29*a*) to be used, then the resulting residual signal (corresponding to the estimated input excitation signal to the p'-th order synthesis filter 29*a*) $e_1$ is fed to the LP inverse filter 41B. The LP inverse filter 41B has set therein the filter coefficients and internal state of the n-th order synthesis filter 29*b* and performs LP inverse filtering of the residual signal $e_1$ to produce the residual signal (corresponding to the estimated input excitation signal to the n-th order synthesis filter 29) $e_2$, which is compared by the comparator 41C with the residual signal $e_1$.

Figure 22:
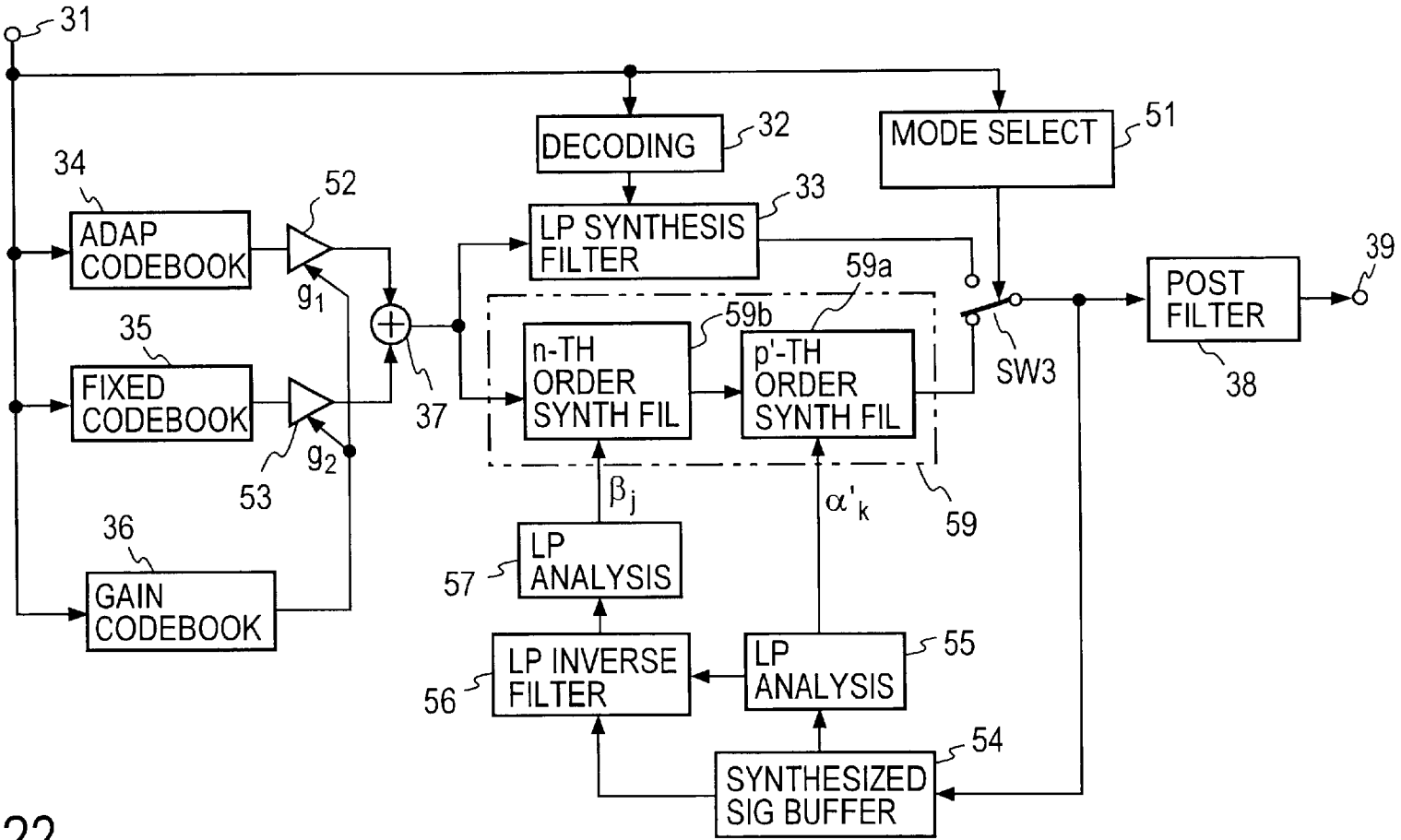
FIG. 22 is a block diagram illustrating the functional configuration of an embodiment of the decoding apparatus according to the present invention.

Next, a description will be given of embodiments of the audio decoding method and apparatus according to the present invention. FIG. 22 is a block diagram illustrating a decoding apparatus corresponding to the coding apparatus shown in FIG. 8, the parts corresponding to those in conventional decoding apparatus of FIG. 2 being identified by the same reference numerals. In this embodiment there are provided, in addition to the p-th order LP synthesis filter 33, a cascade-connected synthesis filter 59 formed by a cascade connection of a p'-th order LP synthesis filter 59*a* and an n-th order LP synthesis filter 59*b*. These synthesis filters 33 and 59 are driven by the excitation signal from the adder 37. In accordance with the input mode code, a switch SW3 is controlled, through which the output from either one of the synthesis filters 33 and 59 is provided as a synthesized signal to the post filter 38.

The input LP coefficient code tis decoded in the decoding part 32, and the decoded p-th LP coefficients $\alpha_i$ are used to set the filter coefficients in the p-th order synthesis filter 33. A synthesized signal buffer 54, an LPC analysis part 55, an LP inverse filter 56 and an LPC analysis part 57 are identical in operation with the synthesized signal buffer 25, the LPC analysis part 26, the LP inverse filter 27 and the LPC analysis part 28 in the coding apparatus of FIG. 8. The synthesized signal via the switch SW3 is stored in the synthesized signal buffer 54, and it is LPC analyzed in the LPC analysis part 55. Based on the resulting p'-th order LP coefficients $\alpha'_k$, the filter coefficients of the p'-th order synthesis filter 59*a* are set. And the p'-th order LP coefficients $\alpha'_k$ are set in the LP inverse filter 56, to which the synthesized signal is applied to generate a residual signal. The residual signal is LPC analyzed in the LPC analysis part 57, and the resulting n-th order LP coefficients $\beta_j$ are set as filter coefficients in the n-th order synthesis filter 59*b*. This embodiment is identical with the FIG. 2 prior art example, and no further description will be given.

Figure 23:
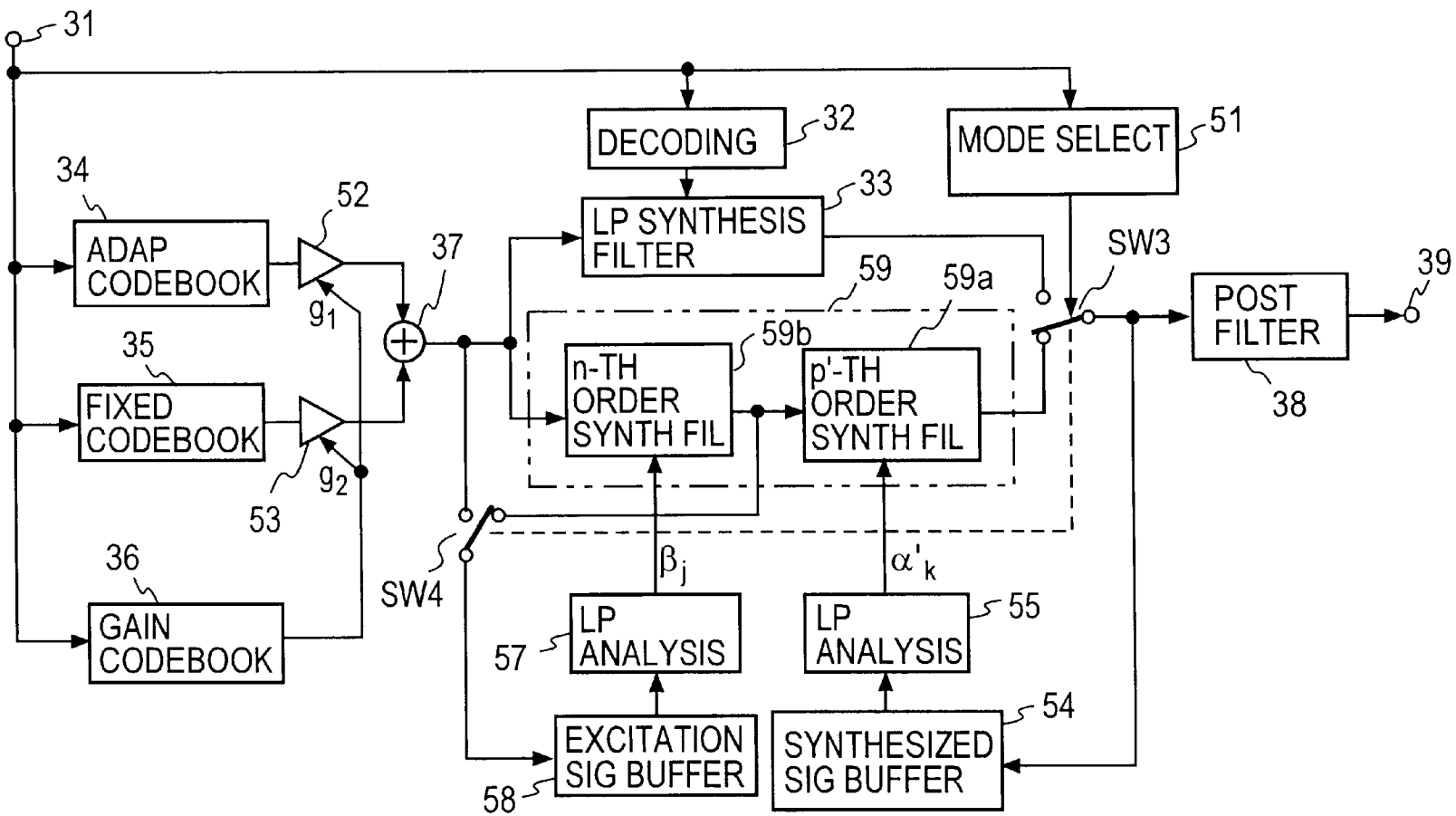
FIG. 23 is a block diagram illustrating the functional configuration of another embodiment of the decoding apparatus according to the present invention.

FIG. 23 depicts in block form another embodiment of the decoding apparatus according to the present invention that corresponds to the coding apparatus of FIG. 12, the parts corresponding to those in FIG. 22 being identified by the same reference numerals. In this embodiment the LP inverse filter 56 in FIG. 22 is omitted, but instead the excitation signal from the adder 37 or the output signal from the n-th order synthesis filter 59*b* is selectively applied via a switch SW4 to an excitation signal buffer 58 for temporary storage therein, then the excitation signal is LPC analyzed in the LPC analysis part 57 to obtain the n-th order LP coefficients $\beta_j$, which are set as filter coefficients in the n-th order synthesis filter 59*b*. The switch SW4 is switched in synchronization with the switch SW3.

Figure 24:
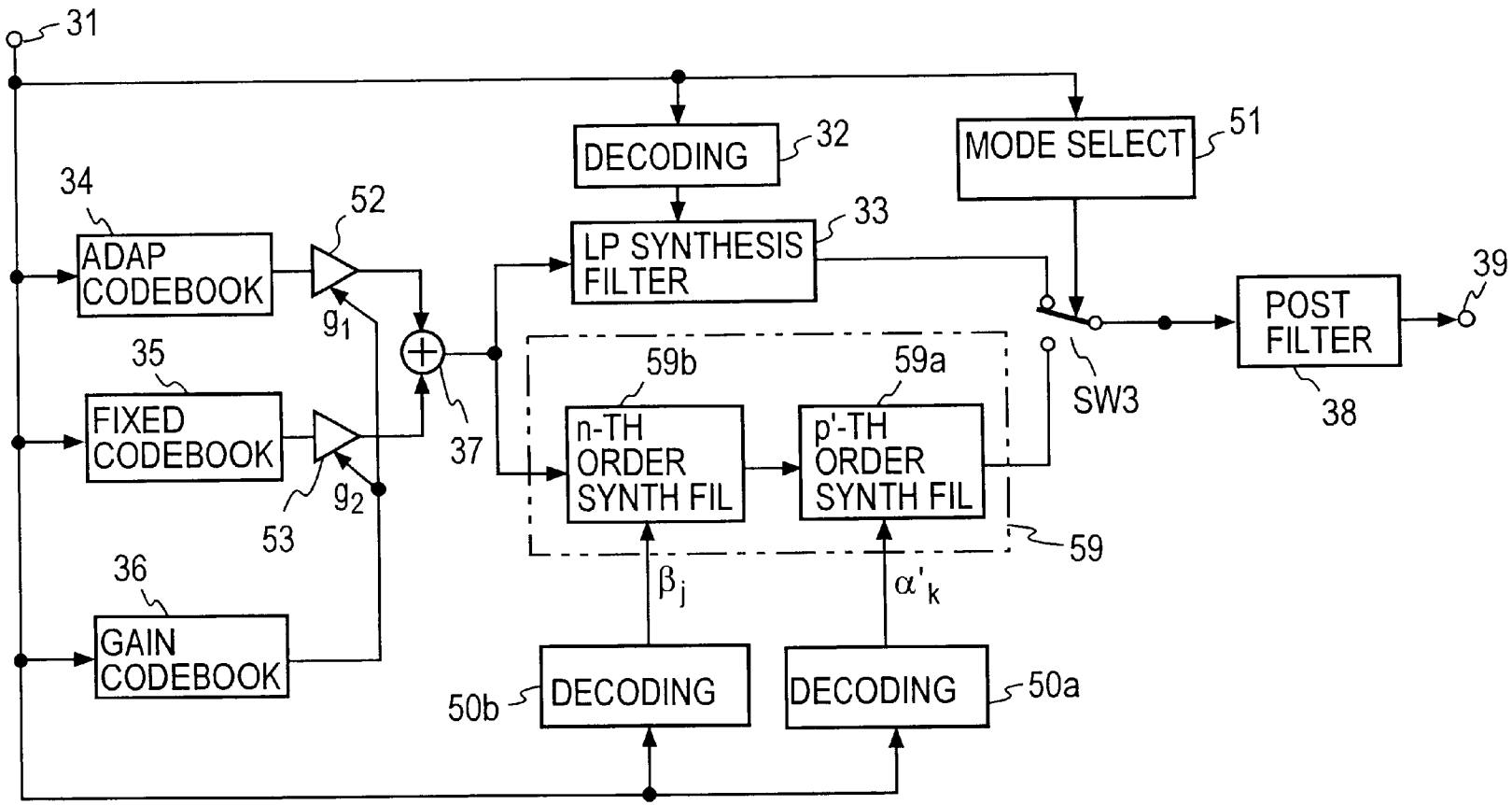
FIG. 24 is a block diagram illustrating the functional configuration of still another embodiment of the decoding apparatus according to the present invention.

In the FIG. 8 embodiment, in the case where the input acoustic signal is fed, as a substitute for the synthesized signal, to the synthesized signal buffer 25, the LP coefficients $\alpha'_k$ and $\beta_j$ of the LPC analysis parts 26 and 28 also need to be encoded and output. In the decoding apparatus in such an instance, as depicted in FIG. 24, the p'-th order LP coefficients $\alpha'_k$ are decoded from the input codes in a decoding part 50*a* and are set in the p'-th order synthesis filter 59*a*, then the n-th order LP coefficients $\beta_j$ are decoded from the input codes in a decoding part 50*b* and are set in the n-th order synthesis filter 59*b*. The other parts and their operations are the same as in the FIG. 22 embodiment.

Figure 25:
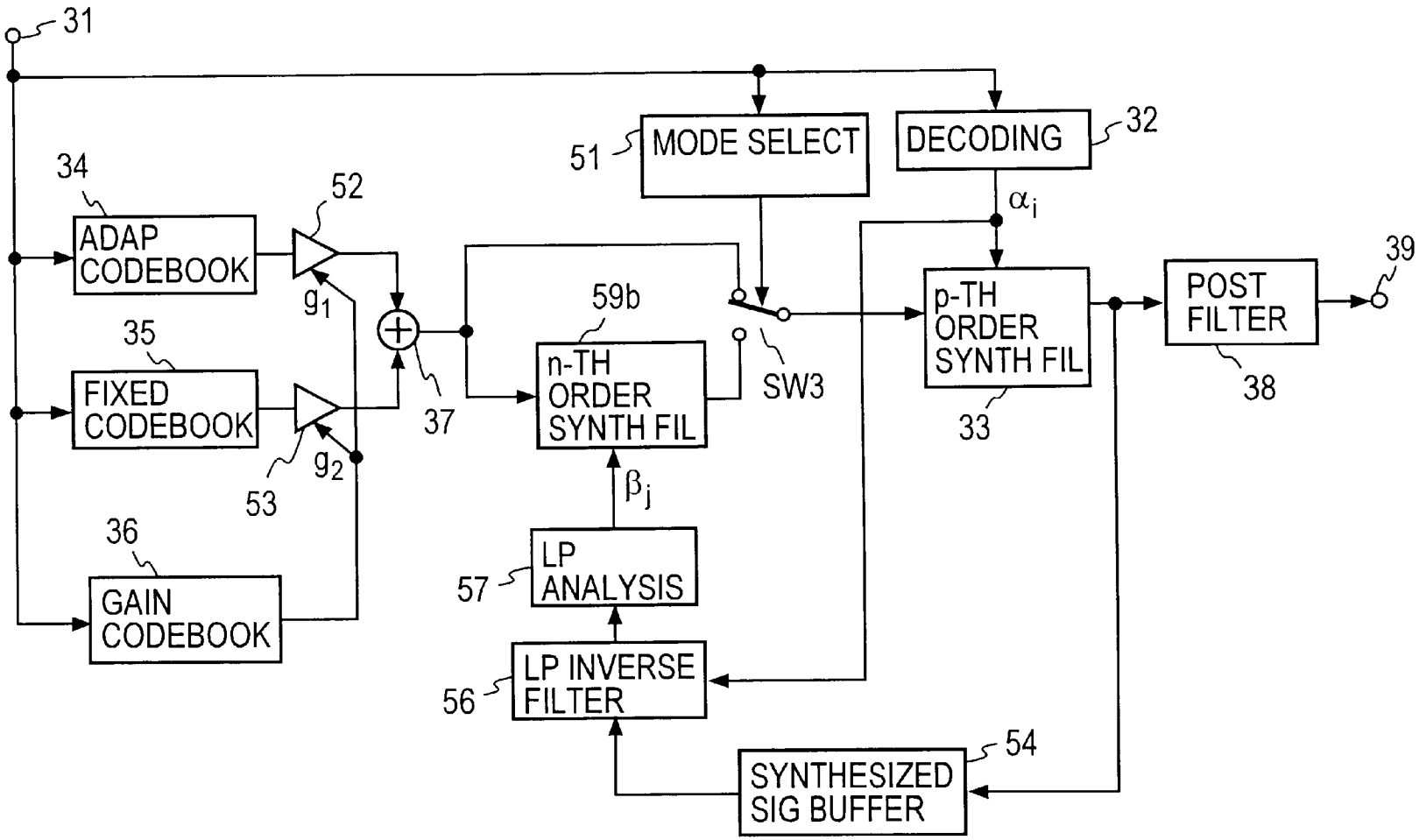
FIG. 25 is a block diagram depicting the functional configuration of an modified form of the decoding apparatus in which part of a cascade-connected synthesis filter is used also as a synthesis filter to be switched therefrom.

FIG. 25 depicts in block form a decoding apparatus corresponding to the coding apparatus of FIG. 18. In this embodiment the outputs of the adder 37 and the n-th order synthesis filter are selectively connected via the switch SW3 to the input of the p-th order synthesis filter 33, the output of which is connected to the input of the post filter 38. The synthesized signal from the p-th order synthesis filter 33 is temporarily stored in the synthesized signal buffer 54, thereafter being applied to the LP inverse filter 56. The filter coefficients of the LP inverse filter 56 are determined based on the p-th order LP coefficients $\alpha_i$ provided from the decoding part 32. The other parts and heir operations are the same as in the FIG. 22 embodiment.

Figure 26:
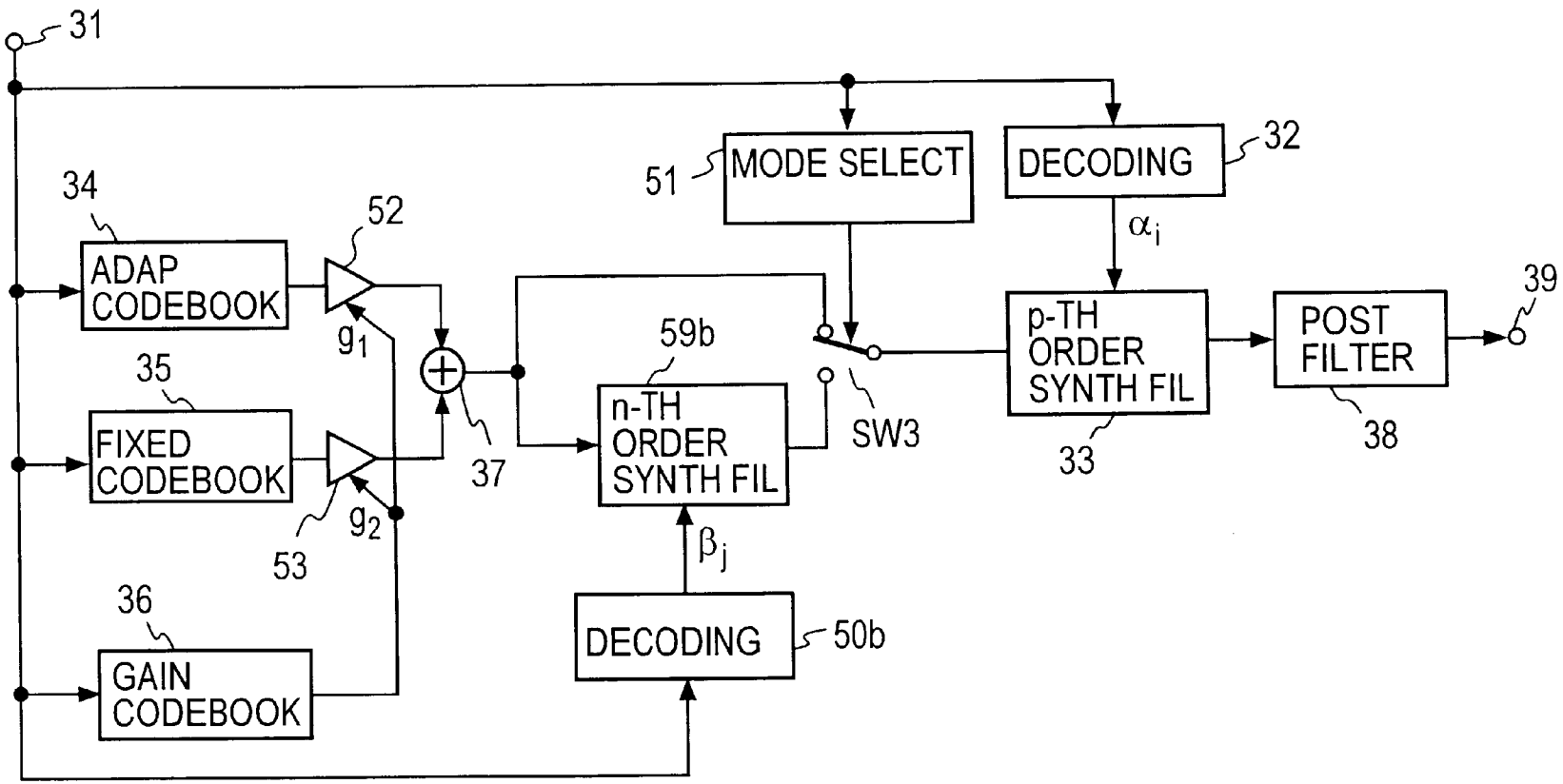
FIG. 26 is a block diagram depicting the functional configuration of another modification of the decoding apparatus shown in FIG. 25.

FIG. 26 illustrates in block form a decoding apparatus corresponding to the coding apparatus of FIG. 17. The synthesized signal buffer 54, the LP inverse filter 56 and the LPC analysis part 57 in FIG. 25 are omitted, and the code representing the n-ty LP coefficients $\beta_j$ is decoded in the decoding part 50*b* and the decoded LP coefficients are set as filter coefficients in the n-th order synthesis filter 59*b*.

Figure 27:
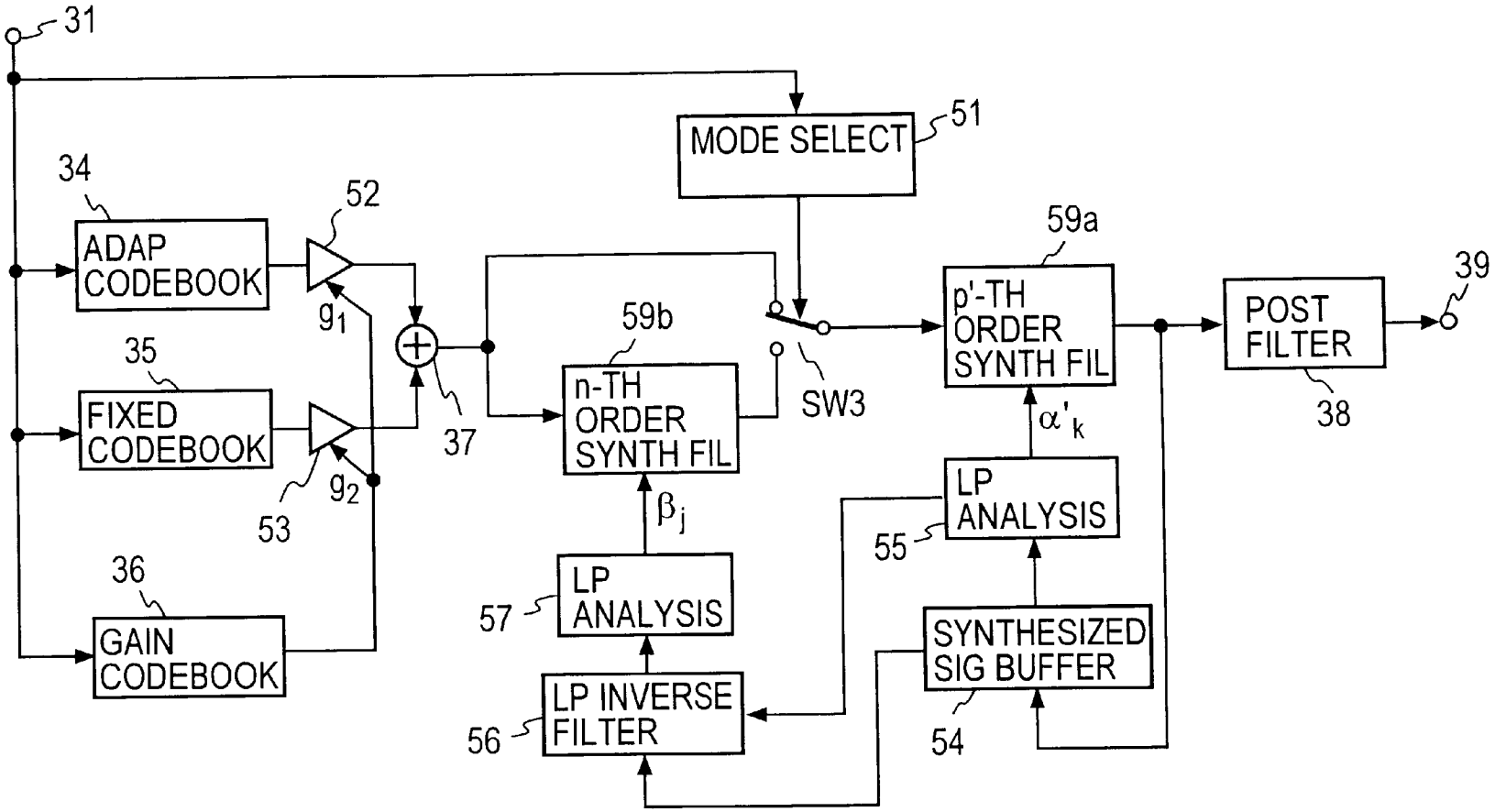
FIG. 27 is a block diagram depicting the functional configuration of another modification of the decoding apparatus of FIG. 25.

FIG. 27 depicts in block form a decoding apparatus corresponding to the coding apparatus of FIG. 19. In this embodiment the p-th order synthesis filter 33 in FIG. 25 is replaced with the p'-th order synthesis filter 59*a* and the p'-th order LP coefficients $\alpha'_k$ obtained by analyzing the synthesized signal in the LPC analysis part 55 are set in the p'-th order synthesis filter 59*a*. As is the case with the FIG. 22 embodiment, the synthesized signal from the synthesized signal buffer 54 is inverse filtered by an LP inverse filter 58 to obtain an residual signal, which is analyzed in the LPC analysis part 57, and the resulting n-th order LP coefficients $\beta_j$ are set in the n-th order synthesis filter 59*b*.

In this case, no LP coefficients code are input into the decoding apparatus, and the decoding part 32 and the p-th order synthesis filter 33 in FIG. 22 are omitted.

Figure 28:
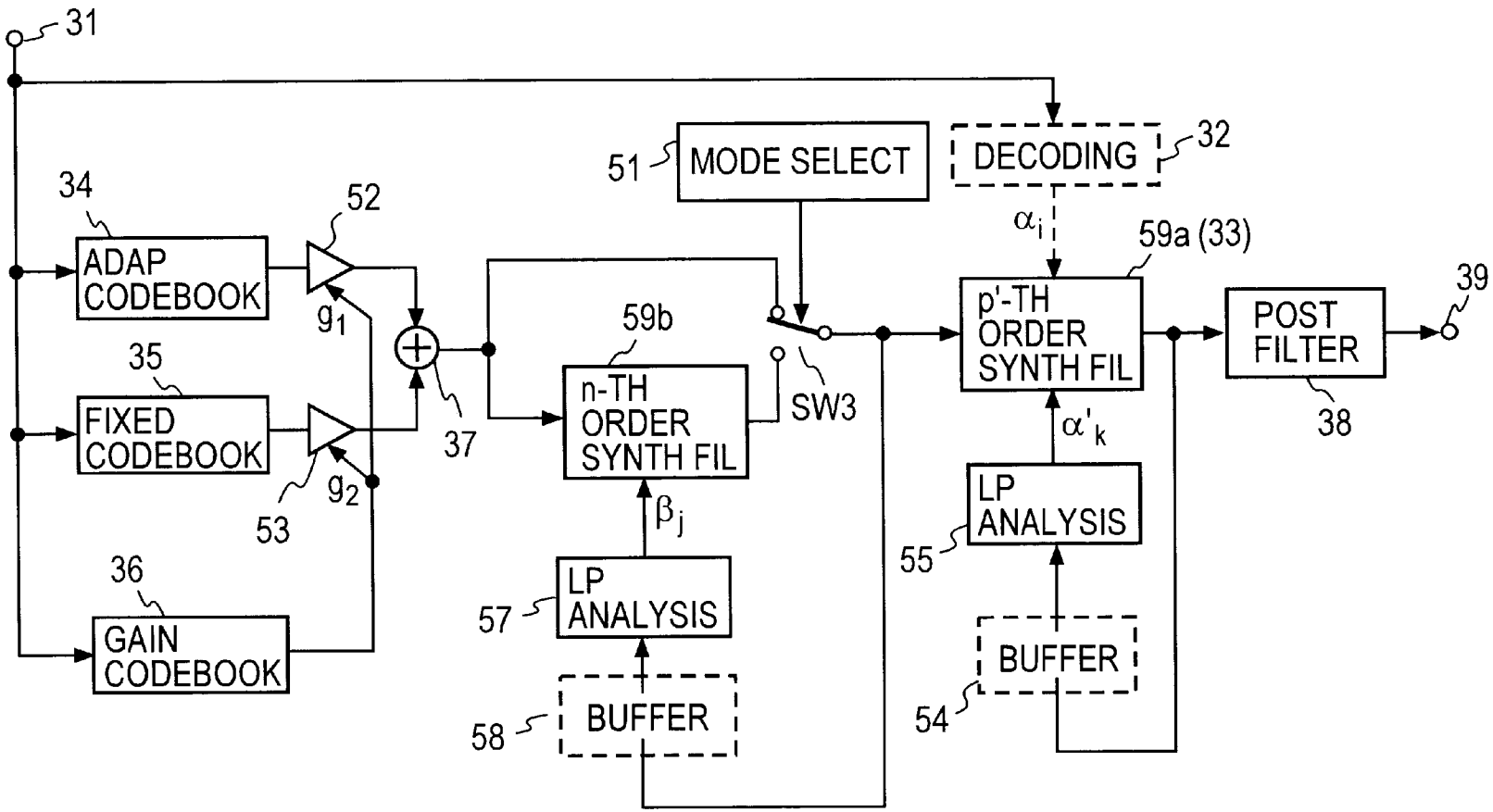
FIG. 28 is a block diagram depicting the functional configuration of still another modification of the decoding apparatus of FIG. 25.

FIG. 28 depicts in block form a decoding apparatus corresponding to a modification of the FIG. 19 coding apparatus in which the LP inverse filter 27 is omitted and the excitation signal is applied to the LPC analysis part 28. The parts corresponding to those in FIG. 27 are identified by the same reference numerals. The LP inverse filter 56 in FIG. 27 is omitted, but instead the excitation signal, which is the output signal from the switch SW3, is provided to the LPC analysis part 57 to obtain the n-th order LP coefficients.

In the case where the LP coefficients code are input into the decoding apparatus of FIG. 28, the p-th order LP coefficients $\alpha_i$ are decoded in the decoding part 32 as indicated by the broken lines, and the p-th order LP coefficients $\alpha_i$ are set in the p-th order synthesis filter 33 in place of the p'-th order synthesis filter 59*a*.

Figure 29:
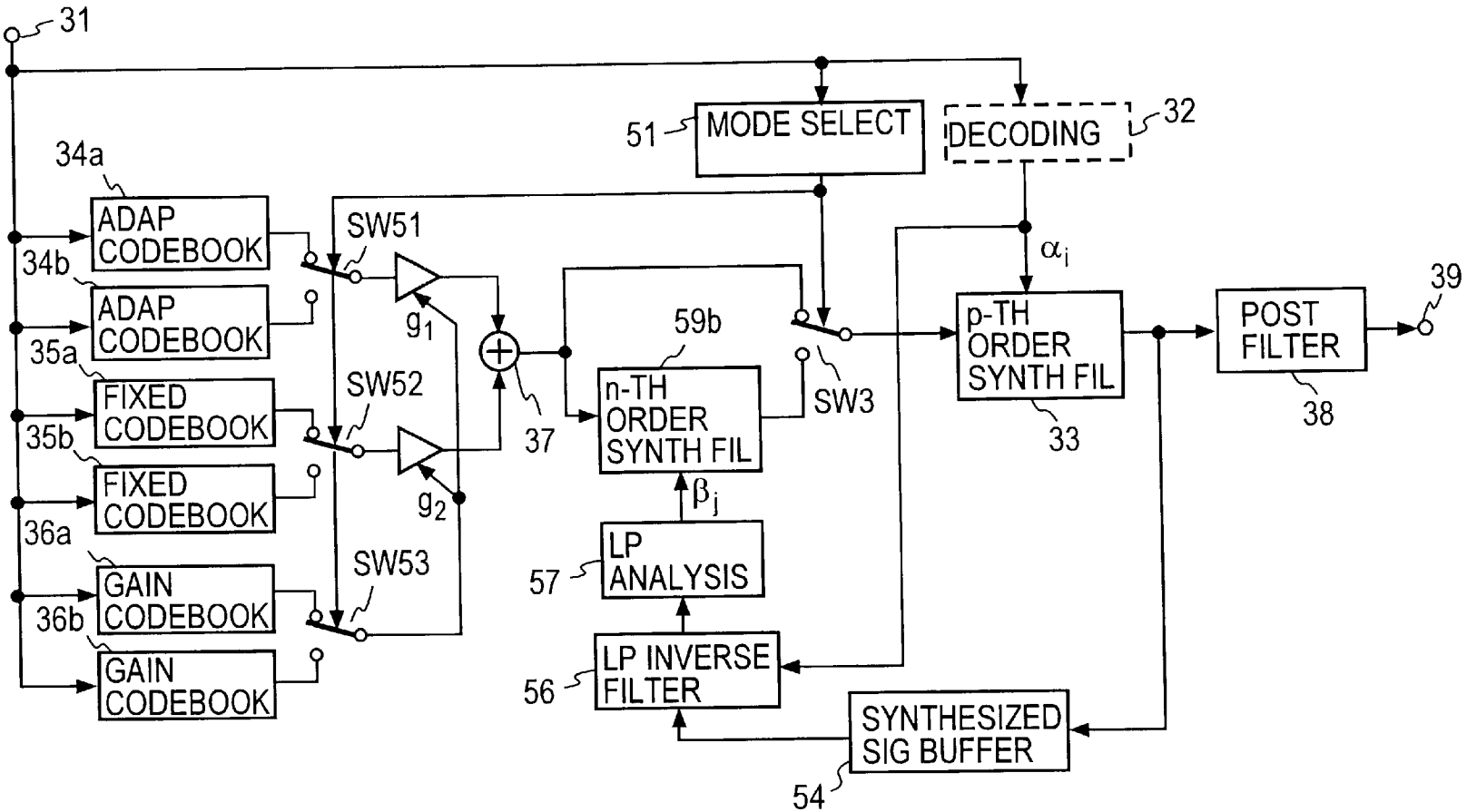
FIG. 29 is a block diagram illustrating the functional configuration of another embodiment of the decoding apparatus according to the present invention in which two different codebooks are provided and selectively used according to a mode code.

In the case where the coding apparatus is adapted to selectively use that one of the two codebooks for each of the adaptive, fixed and gain codebooks which fits the selected synthesis filter, i.e., the LP synthesis filter 14 or the cascade-connected synthesis filter 29, the decoding apparatus is also configured accordingly. For example, the decoding apparatus of FIG. 25 is modified as depicted in FIG. 29. That is, adaptive codebooks 34A, 34B, fixed codebooks 35A, 35B and gain codebooks 36A, 36B are provided, which are identical with the adaptive codebooks 15A, 15B, the fixed codebooks 21A, 21B and the gain codebooks 17A, 17B in FIG. 16. The adaptive codebooks 34A, 34B, the fixed codebooks 35A, 35B and the gain codebooks 36A, 36B are switched by switches SW51, SW53 and SW54 in ganged relation to the switch SW3 so that one of the two codebooks of each pair is selected. The other operations are the same as in the FIG. 25 embodiment. The selective use of one of the two codebooks of each pair in accordance with the mode code as described above is also applicable to the embodiments depicted in FIGS. 22 to 24, 27 and 28.

The functions of the coding and decoding apparatuses described above can also be implemented by executing computer programs.

Figure 30:
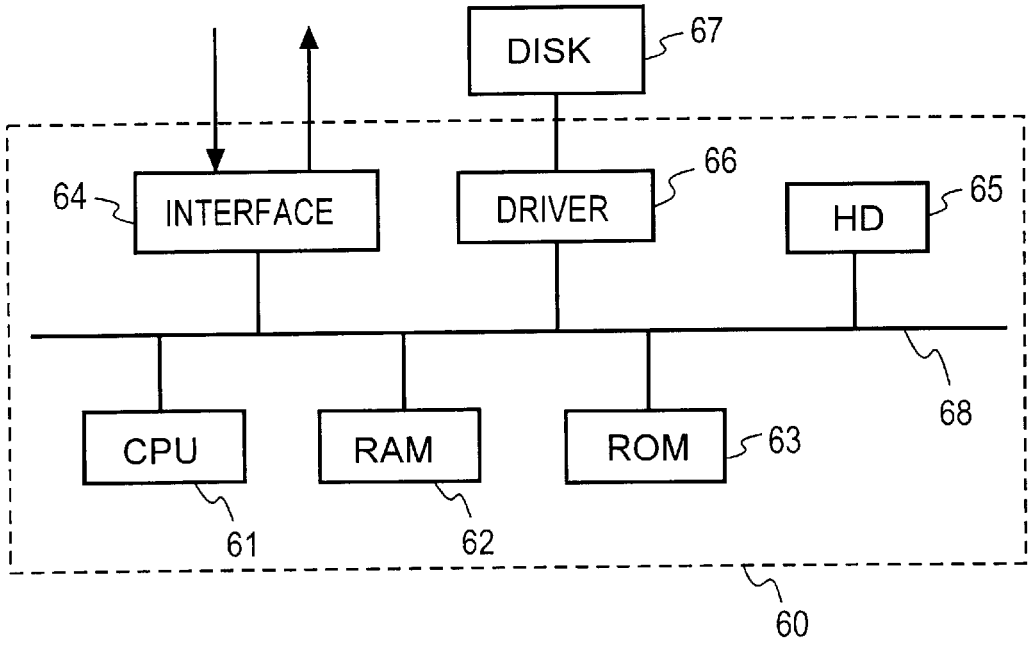
FIG. 30 is a block diagram illustrating the configuration of a computer which is used to perform the coding and decoding methods of the present invention by executing programs recorded on a recording medium.

FIG. 30 illustrates a computer configuration for implementing the coding and decoding methods according to the present invention. A computer 60 includes a CPU 61, a RAM 62, a ROM 63, I/O interface 64, a hard disk 65 and a driver 66 interconnected via a bus 68. The ROM 63 has written therein a basic program for operating the computer 60, and the hard disk 65 has prestored thereon programs for executing the coding and decoding methods according to the present invention. For example, during coding the CPU 61 loads a coding program from the hard disk 65 into the RAM 62, then encodes the input acoustic signal via the interface 54 under the control of the coding program, and outputs codes via the interface 64.

During decoding the CPU 61 loads a decoding program from the hard disk 65 into the RAM 62, then decodes inputs codes under the control of the decoding program, and outputs audio sample signals. The programs for implementing the coding and decoding methods according to the present invention may be programs recorded on an external disk unit 67 connected via the driver 66 to the internal bus 68. The programs for implementing the coding and decoding methods according to the present invention may be recorded on a magnetic recording medium, or such a recording medium as an IC memory or compact disc.

Effect of the Invention

As described above, according to the present invention, a synthesized signal is estimated for an input signal, then the synthesized signal is used to estimate the audio coding quality which would be obtained in the case of using a low-order synthesis filter and the audio coding quality which would be obtained in the case of using a cascade-connected synthesis filter formed by a cascade connection of high- and low-order synthesis filters, and audio coding is performed using the synthesis filter which provides higher quality in coding. With such a configuration, for example, in the case of encoding a signal whose waveform abruptly changes with time, the low-order filter is selected in which are set predictive coefficients obtained from only a low-order linear prediction for expressing the spectral envelope, and in the case of encoding a music signal whose frequency characteristic deviates significantly, the cascade-connected synthesis filter is selected in which are set predictive coefficients obtained by the low-order linear prediction for expressing the spectral envelope and a high-order linear prediction for expressing a fine spectral structure of a residual signal of the low-order linear prediction. Hence, it is possible to achieve high quality audio coding regardless of the characteristic of the input signal.

According to the decoding apparatus and method of the present invention, a low-order synthesis filter and a cascade-connected synthesis filter composed of low- and high-order synthesis filters are provided, and that one of the synthesis filters which fits the synthesized signal to be decoded is selected in accordance with the input mode code--this ensures high quality audio coding.

What is claimed is:

1. An audio coding method for encoding an input acoustic signal by generating a synthesized acoustic signal through the use of codebook means and searching said codebook means for indices which will minimize an error between said input acoustic signal and said synthesized acoustic signal, said method comprising the steps of:

(a) estimating said synthesized acoustic signal for said input acoustic signal;

(b) determining, from at least one of said input acoustic signal and said estimated synthesized acoustic signal, coefficients of a p-th order first LP synthesis filter and coefficients of a cascade-connected synthesis filter composed of a p'-th order second LP synthesis filter and an n-th order third LP synthesis filter, said order p' being equal or nearly equal to said order p and said order n being higher than said order p;

(c) estimating, as first and second excitation signals for driving said first LP synthesis filter and said cascade-connected synthesis filter, respectively, first and second residual signals obtained by inverse filtering of said estimated synthesized acoustic signal by a first inverse filter of an inverse characteristic to said first LP synthesis filter and a second inverse filter of an inverse characteristic to said cascade-connected synthesis filter;

(d) determining from said first and second excitation signals which of said first LP synthesis filter and said cascade-connected synthesis filter will provide higher coding quality, and based on the result of determination, selecting, as a synthesis filter for audio coding, that one of said first LP synthesis filter and said cascade-connected synthesis filter which will provide higher coding quality;

(e) providing a gain to an excitation vector selected from codebook means to obtain an excitation signal, generating a synthesized acoustic signal by applying said excitation signal to that one of said first LP synthesis filter and said cascade-connected synthesis filter selected as said synthesis filter for audio coding, and computing an error between said input acoustic signal and said synthesized acoustic signal;

(f) determining said excitation vector and said gain which will minimize said error between said synthesized acoustic signal generated by repeating said step (e); and (g) outputting at least codebook indices representing said determined excitation vector, a gain index representing said determined gain and a mode code representing which one of said first LP synthesis filter and said cascade-connected synthesis filter has been selected.

2. The coding method of claim 1, wherein said step (b) comprises the steps of:

(b-1) performing a p-th order LPC analysis on said input acoustic signal to obtain first LP coefficients and setting them in said first LP synthesis filter;

(b-2) performing a p'-th order LPC analysis of a previous synthesized acoustic signal to obtain second LP coefficients;

(b-3) performing LP inverse filtering of said previous synthesized acoustic signal based on said second LP coefficients to obtain an LP residual signal;

(b-4) performing an n-th order LPC analysis on said LP residual signal to obtain third LP coefficients; and (b-5) setting said second LP coefficients and said third LP coefficients in said second and third LP synthesis filters of said cascade-connected synthesis filter, respectively; and wherein said codebook indices in said step (g) contain a code indicating said first LP coefficients.

3. The coding method of claim 1, wherein said step (b) comprises the steps of:

(b-1) performing a p-th order LPC analysis on said input acoustic signal to obtain first LP coefficients and setting them in said first LP synthesis filter;

(b-2) performing a p'-th order LPC analysis on a previous synthesized acoustic signal to obtain second LP coefficients;

(b-3) performing an n-th order LPC analysis on a previous excitation signal to obtain an LP residual signal;

(b-4) performing an n-th order LPC analysis on said LP residual signal to obtain third LP coefficients; and (b-5) setting said second LP coefficients and said third LP coefficients in said second and third LP synthesis filters of said cascade-connected synthesis filter, respectively; and wherein said codebook indices in said step (g) contain a code indicating said first LP coefficients.

4. The coding method of claim 1, wherein: p=p'; said first and second LP synthesis filters are formed by the same p-th order synthesis filter; and said step (b) comprises the steps of:

(b-1) performing a p-th order LPC analysis on said input acoustic signal to obtain first LP coefficients;

(b-2) performing LP inverse filtering on said input acoustic signal based on said first LP coefficients to obtain an LP residual signal;

(b-3) performing an n-th order LPC analysis on said LP residual signal to obtain second LP coefficients; and (b-4) setting said first LP coefficients and said second LP coefficients in said p-th order synthesis filter and said second LP synthesis filter, respectively; and wherein said codebook indices in said step (g) contain a code indicting said first LP coefficients and a code indicating said n-th order LP coefficients.

5. The coding method of claim 1, wherein: p=p'; said first and second LP synthesis filters are formed by the same p-th order synthesis filter; and said step (b) comprises the steps of:

(b-1) performing a p-th order LPC analysis on said input acoustic signal to obtain first LP coefficients;

(b-2) performing an n-th order LPC analysis on a previous excitation signal to obtain second LP coefficients; and (b-3) setting said first LP coefficients and said second LP coefficients in said p-th order synthesis filter and said second LP synthesis filter, respectively; and wherein said codebook indices in said step (g) contain a code indicating said first LP coefficients.

6. The coding method of claim 1, wherein: p=p'; said first and second LP synthesis filters are formed by the same p-th order synthesis filter; and said step (b) comprises the steps of:

(b-1) performing a p-th order LPC analysis on a previous synthesized acoustic signal to obtain first LP coefficients;

(b-2) performing LP inverse filtering on said previous synthesized acoustic signal based on said first LP coefficients to obtain an LP residual signal;

(b-3) performing an n-th order LPC analysis on said LP residual signal to obtain second LP coefficients; and (b-4) setting said first LP coefficients and said second LP coefficients in said p-th order synthesis filter and said second LP synthesis filter, respectively.

7. The coding method of claim 1, wherein: p=p'; said first and second LP synthesis filters are formed by the same p-th order synthesis filter; and said step (b) comprises the steps of:

(b-1) performing a p-th order LPC analysis on a previous synthesized acoustic signal to obtain first LP coefficients;

(b-2) performing an n-th order LPC analysis on a previous excitation signal to obtain a second LP coefficients; and (b-3) setting said first LP coefficients and said second LP coefficients in said p-th order synthesis filter and said second LP synthesis filter, respectively.

8. The coding method of any one of claims 2 to 7, wherein said step (c) comprises the steps of:

(c-1) performing LP inverse filtering on said input acoustic signal, regarded as said estimated synthesized acoustic signal, based on said first LP coefficients to obtain a first LP residual signal; and (c-2) performing LP inverse filtering of said input acoustic signal through the use of the filter coefficients of said cascade-connected synthesis filter to obtain a second LP residual signal; and wherein said step (d) is a step of comparing the power of said first LP residual signal and the power of said second LP residual signal as an index of the audio coding quality and selecting said first LP synthesis filter or said cascade-connected synthesis filter, depending on whether or not the power of said first LP residual signal is smaller than the power of said second LP residual signal.

9. The coding method of claim 8, wherein said step (d) is a step of comparing adaptively weighted powers of said first and second LP residual signals.

10. The coding method of any one of claims 2 to 7, wherein said step (c) comprises the steps of:

(c-1) performing LP inverse filtering on said input acoustic signal, regarded as said estimated synthesized acoustic signal, based on said first LP coefficients to obtain a first LP residual signal as a first estimated excitation signal at the time the output from said p-th LP synthesis filter is selected; and (c-2) performing LP inverse filtering on said input acoustic signal through the use of the filter coefficients of said cascade-connected synthesis filter to obtain a second LP residual signal as a second estimated excitation signal at the time said cascade-connected synthesis filter is selected; and wherein said step (d) is a step of comparing the power of said first estimated excitation signal and the power of said second estimated excitation signal as an index of the audio coding quality and selecting said first LP synthesis filter or said cascade-connected synthesis filter, depending on whether or not the power of said first estimated excitation signal is smaller than the power of said second estimated excitation signal.

11. The coding method of any one of claims 2 to 7, wherein said step (f) is a step of performing perceptual weighting on said error and determining said codebook indices and said gain index such that said perceptually weighted error is minimized, and said step (c) comprises the steps of:

(c-1) performing perceptual weighting on said input acoustic signal and providing an inverse characteristic of said perceptual weighting to said perceptually weighted input acoustic signal to obtain said estimated synthesized acoustic signal;

(c-2) performing LP inverse filtering on said estimated synthesized acoustic signal based on said first LP coefficients to obtain a first LP residual signal; and (c-3) performing LP inverse filtering on said estimated synthesized acoustic signal based on the filter coefficients of said cascade-connected synthesis filter to obtain a second LP residual signal;

and wherein said step (d) is a step of comparing the power of said first LP residual signal and the power of said second LP residual signal as an index of the audio coding quality and selecting said first LP synthesis filter or said cascade-connected synthesis filter, depending on whether or not the power of said first LP residual signal is smaller than the power of said second LP residual signal.

12. The coding method of any one of claims 2 to 7, wherein said step (f) is a step of performing perceptual weighting on said error and determining said codebook indices and said gain index such that said perceptually weighted error is minimized, and said step (c) comprises the steps of:

(c-1) providing an inverse characteristic of said perceptual weighting to a zero input to estimate an error between said input acoustic signal and a synthesized acoustic signal to be estimated;

(c-2) subtracting said estimated error from said input acoustic signal to obtain said estimated synthesized acoustic signal;

(c-3) performing LP inverse filtering on said estimated synthesized acoustic signal based on the first LP coefficients to obtain said first LP residual signal; and (c-4) performing LP inverse filtering on said estimated synthesized acoustic signal based on the filter coefficients of said cascade-connected synthesis filter to obtain said second LP residual signal;

and wherein said step (d) is a step of comparing the power of said first LP residual signal and the power of said second LP residual signal as an index of the audio coding quality and selecting said first LP synthesis filter or said cascade-connected synthesis filter, depending on whether or not the power of said first LP residual signal is smaller than the power of said second LP residual signal.

13. The coding method according to any one of claims 1 to 7, wherein said codebook means comprises first codebook means prepared using said p-th order synthesis filter and second codebook means prepared using said n-th order synthesis filter, said codebook means being switched between said first and second codebook means to search for said excitation vector in accordance with the selection of either one of said first LP synthesis filter and said cascade-connected synthesis filter by said determination in said step (d).

14. The coding method according to any one of claims 1 to 7, wherein said order n is at least twice higher than the order of said first LP synthesis filter.

15. A coding apparatus for encoding an input acoustic signal by generating a synthesized acoustic signal through the use of codebook means and searching said codebook means for indices which will minimize an error between said input acoustic signal and said synthesized acoustic signal, said apparatus comprising:

synthesis filter means for selectively offering a p-th order first LP synthesis filter and a cascade-connected synthesis filter formed by a cascade connection of a p'-th order second LP synthesis filter and an n-th order third LP synthesis filter, a selectively offered one of said first LP synthesis filter and said cascade-connected synthesis filter being driven by an input excitation signal to generate a synthesized acoustic signal, and said order p' is equal or nearly equal to said order p and said order n being higher than said order p;

coefficients determination means determining, from at least one of said input acoustic signal and said estimated synthesized acoustic signal, coefficients of said p-th order first LP synthesis filter and coefficients of said cascade-connected synthesis filter and for setting said coefficients in said first LP synthesis filter and said cascade-connected synthesis filter, respectively;

mode decision means comprising: a first inverse filter having a characteristic inverse to said first LP synthesis filter, for performing inverse filtering on a synthesis acoustic signal estimated from said input acoustic signal to generate a first residual signal as a first estimated excitation signal; a second inverse filter having a characteristic inverse to said cascade-connected synthesis filter, for performing inverse filtering of said estimated synthesized acoustic signal to generate a second residual signal as a second estimated excitation signal; and comparison/decision means for deciding from said first and second estimated excitation signal which of said first LP synthesis filter and said cascade-connected synthesis filter will provide higher audio coding quality; said mode decision means selecting, as a synthesis filter for coding, that one of said first LP synthesis filter and said cascade-connected synthesis filter which has been decided to provide higher audio coding quality;

codebook means having held therein excitation vectors;

gain providing means for providing a gain to an excitation vector selected from said codebook means and for applying said gain-imparted excitation vector as said excitation signal to said selected one of said first LP synthesis filter and said cascade-connected synthesis filter;

subtractor means for calculating an error between said synthesized acoustic signal generated by said synthesis filter means and said input acoustic signal; and control means for determining an excitation vector to be selected from said codebook means and a gain to be imparted to said selected excitation vector by said gain providing means, and for outputting at least an index indicating said determined excitation vector, an index indicating said determined gain and a code indicating which of said first LP synthesis filter and said cascade-connected synthesis filter has been selected by said mode decision means.

16. The coding apparatus of claim 15, wherein said coefficients determining means comprises:

first LPC analysis means for performing a p-th order LPC analysis on said input acoustic signal to obtain first LP coefficients and for setting them in said first LP synthesis filter;

a synthesized acoustic signal buffer for temporarily storing said synthesized acoustic signal;

second LPC analysis means for performing a p'-th order LPC analysis onsaid synthesized acoustic signal stored in said synthesized acoustic signal buffer to obtain second LP coefficients and for setting it in said second LP synthesis filter;

an LP inverse filter having set therein filter coefficients based on said p'-th order LP coefficients, for performing LP inverse filtering on said synthesized acoustic signal fed from said synthesized acoustic signal buffer to obtain an LP residual signal; and third LPC analysis means for per forming an n-th order LPC analysis on said LP residual signal to obtain n-th order LP coefficients and for setting them in said third LP synthesis filter; and wherein said output codes from said control means contain a code indicating said p-th order LP coefficients.

17. The coding apparatus of claim 15, wherein said coefficients determining means comprises:

first LPC analysis means for performing a p-th order LPC analysis on said input acoustic signal to obtain first LP coefficients and for setting them in said first LP synthesis filter;

a synthesized acoustic signal buffer for temporarily storing said synthesized acoustic signal;

second LPC analysis means for performing a p'-th order LPC analysis on said synthesized acoustic signal stored in said synthesized acoustic signal buffer to obtain second LP coefficients and for setting it in said second LP synthesis filter;

an excitation signal buffer for temporarily storing said excitation signal; and third LPC analysis means for performing an n-th order LPC analysis on said excitation signal in said excitation signal buffer to obtain an n-th order LP coefficients and for setting them in said third LP synthesis filter; and wherein said output codes from said control means contain a code indicating said p-th order LP coefficients.

18. The coding apparatus of claim 15, wherein p=p' and said first and second LP synthesis filters are formed by the same p-th order synthesis filter, and wherein:

said synthesis filter means includes switching means for connecting the input of said third LP synthesis filter to the input of said p-th order synthesis filter to bypass said third LP synthesis filter, or for connecting the output of said third LP synthesis filter to the input of said p-th order LP synthesis filter to form said cascade-connected synthesis filter; and said coefficients determining means comprises:

first LPC analysis means for performing a p-th order LPC analysis on said input acoustic signal to obtain a first LP coefficients and for setting them in said p-th order LP synthesis filter;

an LP inverse filter having set therein filter coefficients based on said p-th LP coefficients, for performing LP inverse filtering on said input acoustic signal to obtain an LP residual signal; and second LPC analysis means for performing an n-th order LPC analysis of said LP residual signal to obtain n-th LP coefficients and for setting them in said third LP synthesis filter; and wherein said output codes of said control means contain a code indicating said p-th order LP coefficients and a code indicating said n-th order LP coefficients.

19. The coding apparatus of claim 15, wherein p=p' and said first and second LP synthesis filters are formed by the same p-th order synthesis filter, and wherein:

said synthesis filter means includes switching means for connecting the input of said third LP synthesis filter to the input of said p-th order synthesis filter to bypass said third LP synthesis filter, or for connecting the output of said third LP synthesis filter to the input of said p-th order LP synthesis filter to form said cascade-connected synthesis filter; and said coefficients determining means comprises:

first LPC analysis means for performing a p-th order LPC analysis on said input acoustic signal to obtain first LP coefficients and for setting them in said p-th order LP synthesis filter; and second LPC analysis means for performing an n-th order LPC analysis on a previous input excitation signal of said p-th order synthesis filter to obtain n-th LP coefficients and for setting them in said third LP synthesis filter; and wherein said output codes of said control means contain a code indicating said p-th order LP coefficients.

20. The coding apparatus of claim 15, wherein p=p' and said first and second LP synthesis filters are formed by the same p-th order synthesis filter, said synthesis filter means including switching means for connecting the input of said third LP synthesis filter to the input of said p-th order synthesis filter to bypass said third LP synthesis filter, or for connecting the output of said third LP synthesis filter to the input of said p-th order LP synthesis filter to form said cascade-connected synthesis filter; and wherein said coefficients determining means comprises:

first LPC analysis means for performing a p-th order LPC analysis on a previous output synthesized acoustic signal of said p-th order synthesis filter to obtain p-th LP coefficients and for setting them in said p-th order LP synthesis filter;

an LP inverse filter having set therein said p-th LP coefficients, for performing inverse filtering on said previous output synthesized output signal to obtain an LP residual signal; and second LPC analysis means for performing an n-th order LPC analysis on said LP residual signal to obtain n-th LP coefficients and for setting them in said third LP synthesis filter.

21. The coding apparatus of claim 15, wherein p=p' and said first and second LP synthesis filters are formed by the same p-th order synthesis filter, said synthesis filter means including switching means for connecting the input of said third LP synthesis filter to the input of said p-th order synthesis filter to bypass said third LP synthesis filter, or for connecting the output of said third LP synthesis filter to the input of said p-th order LP synthesis filter to form said cascade-connected synthesis filter; and wherein said coefficients determining means comprises:

first LPC analysis means for performing a p-th order LPC analysis on a previous output synthesized acoustic signal of said p-th order synthesis filter to obtain p-th order LP coefficients and for setting them in said p-th order LP synthesis filter; and second LPC analysis means for performing an n-th order LPC analysis on a previous input excitation signal of said p-th order synthesis filter to obtain n-th LP coefficients and for setting them in said third LP synthesis filter.

22. The coding apparatus of any one of claims 16 to 21, wherein:

said first inverse filter has set therein said p-th order LP coefficients and performs LP inverse filtering on said input acoustic signal as said estimated synthesized acoustic signal to generate said first LP residual signal;

said second inverse filter has set therein the filter coefficients of said cascade-connected synthesis filter and performs LP inverse filtering on said input acoustic signal as said estimated synthesized acoustic signal to generate said second LP residual signal; and said comparison/decision means compares the power of said first LP residual signal and the power of said second LP residual signal as an index of the audio coding quality and controls said switching means to select the output from said first LP synthesis filter or the output from said cascade-connected synthesis filter, depending on whether or not the power of said first LP residual signal is smaller than the power of said second LP residual signal.

23. The coding apparatus of any one of claims 18 to 21, wherein:

said first inverse filter has set therein said p-th order LP coefficients and performs LP inverse filtering on said input acoustic signal as said estimated synthesized acoustic signal to generate said first LP residual signal as said first estimated excitation signal at the time of said p-th order synthesis filter being selected;

said second inverse filter has set therein said n-th order LP coefficients and performs LP inverse filtering on said first LP residual signal to generate said second LP residual signal as a second estimated excitation signal at the time of said cascade-connected synthesis filter being selected; and said comparison/decision means compares the power of said first estimated excitation signal and the power of said second estimated excitation signal as an index of the audio coding quality and controls said switching means to select the output from said first LP synthesis filter or the output from said cascade-connected synthesis filter, depending on whether or not the power of said first estimated excitation signal is smaller than the power of said second estimated excitation signal.

24. The coding apparatus according to any one of claims 15 to 21, which further comprises a perceptual weighting filter for perceptually weighting said error to generate a perceptually weighted error, and wherein:

said mode decision means includes an estimating perceptual weighting filter for perceptually weighting said input acoustic signal to generate an estimated perceptually weighted synthesized acoustic signal, and a perceptual weighting inverse filter for providing an inverse characteristic of perceptual weighting to said estimated perceptually weighted synthesized acoustic signal to generate said estimated synthesized acoustic signal;

said first inverse filter has set therein said p-th LP coefficients and performs LP inverse filtering of said estimated synthesized acoustic signal to generate said first LP residual signal;

said second inverse filter has set therein the coefficients of said cascade-connected synthesis filter and performs LP inverse filtering on said estimated synthesized acoustic signal to generate said second LP residual signal; and said comparison/decision means compares the power of said first LP residual signal and the power of said second LP residual signal as an index of the audio coding quality and controls said switching means to select the output from said first LP synthesis filter or the output from said cascade-connected synthesis filter, depending on whether or not the power of said first LP residual signal is smaller than the power of said second LP residual signal.

25. The coding apparatus according to any one of claims 15 to 21, which further comprises a perceptual weighting filter for perceptually weighting said error to generate a perceptually weighted error, and wherein:

said mode decision means includes an estimating perceptual weighting filter for perceptually weighting a zero input to generate an estimated perceptually weighted error, and subtractor means for subtracting said estimated perceptually weighted error from said input acoustic signal to generate said estimated synthesized acoustic signal;

said first inverse filter has set therein said p-th LP coefficients and performs LP inverse filtering on said estimated synthesized acoustic signal to generate said first LP residual signal;

said second inverse filter has set therein the coefficients of said cascade-connected synthesis filter and performs LP inverse filtering on said estimated synthesized acoustic signal to generate said second LP residual signal; and said comparison/decision means compares the power of said first LP residual signal and the power of said second LP residual signal as an index of the audio coding quality and controls said switching means to select the output from said first LP synthesis filter or the output from said cascade-connected synthesis filter, depending on whether or not the power of said first LP residual signal is smaller than the power of said second LP residual signal.

26. The coding apparatus of claim 15, wherein said codebook means and said gain providing means respectively comprise a first excitation vector codebook and a first gain codebook prepared using said p-th order synthesis filter, and a second excitation vector codebook and a second gain codebook prepared using said n-th order synthesis filter, said codebook means being switched between said first and second excitation vector codebooks and between said first and second gain codebooks to search for said excitation vector in accordance with the selection of either one of said first LP synthesis filter and said cascade-connected synthesis filter by said mode decision.

27. An audio decoding method for decoding an acoustic signal from input codes containing at least a codebook index, a gain index and a mode code, said method comprising the steps of:

(a) selecting an excitation vector from an excitation vector codebook by said codebook index;

(b) providing a gain, selected from a gain codebook by said gain index, to said excitation vector to generate an excitation signal;

(c) generating p-th order LP coefficients, a p'-th order LP coefficients and n-th order LP coefficients from at least one of said input code and a previous synthesized acoustic signal and setting them in a p-th order LP synthesis filter, a p'-th order LP synthesis filter and an n-th order LP synthesis filter, respectively, said order p being equal or nearly equal to said order p' and said order n being higher than said order p;

(d) selecting one of said p-th order LP synthesis filter and a cascade-connected synthesis filter composed of p'- and n-th order LP synthesis filters cascade-connected to each other in accordance with said mode code; and (e) driving said selected one of said p-th order LP synthesis filter and said cascade-connected synthesis filter by said excitation signal to generate a synthesized acoustic signal.

28. The decoding method of claim 27, wherein said input codes contain an LP coefficient code and said step (c) comprises the steps of:

(c-1) decoding said LP coefficient code into p-th order LP coefficients and setting them in said p-th order LP synthesis filter;

(c-2) performing an LPC analysis on a previous synthesized acoustic signal to obtain p'-th order LP coefficients and setting them in said p'-th order LP synthesis filter;

(c-3) performing inverse filtering on said previous synthesized acoustic signal by an LP inverse filter having set therein said p'-th order LP coefficients to obtain an LP residual signal; and (c-4) performing an n-th order LPC analysis on said LP residual signal to obtain n-th order LP coefficients and setting them in said n-th order LP filter.

29. The decoding method of claim 27, wherein said input codes contain an LP coefficient code and said step (c) comprises the steps of:

(c-1) decoding said LP coefficient code into p-th order LP coefficients and setting them in said p-th order LP synthesis filter;

(c-2) performing an LPC analysis of a previous synthesized acoustic signal stored in a synthesized acoustic signal buffer to obtain p'-th order second LP coefficients and setting them in said p'-th order LP synthesis filter;

(c-3) performing an n-th order LPC analysis of a previous excitation signal stored in an excitation signal buffer to obtain an n-th order LP coefficients and setting them in said n-th order LP filter; and (c-4) selecting said excitation signal or the output signal from said n-th order LP synthesis filter in accordance with said mode code and storing it in as said previous excitation signal in said excitation signal buffer.

30. The decoding method of claim 27, wherein said input codes contain an LP coefficient code and said step (c) comprises the steps of:

(c-1) decoding said LP coefficient code to p-th order LP coefficients and setting them in said p-th order LP synthesis filter; and (c-2) decoding said LP coefficient code into p'- and n-th order LP coefficients and setting them in said p'- and n-th order LP synthesis filters forming said cascade-connected synthesis filter, respectively.

31. The decoding method of claim 27, wherein: p'=p; said p-th order LP synthesis filter and said p'-th order LP synthesis filter are formed by the same p-th order LP synthesis filter; said input codes contain an LP coefficient code; and said step (c) comprises the steps of:

(c-1) decoding said LP coefficient code into p-th order LP coefficients and setting them in said p-th order LP synthesis filter;

(c-2) performing LP inverse filtering on a previous synthesized acoustic signal through the use of said p-th order LP coefficients to generate an LP residual signal; and (c-3) performing an n-th order LPC analysis of said LP residual signal to obtain n-th order LP coefficients and setting them in said n-th order LP synthesis filter.

32. The decoding method of claim 27, wherein: p'=p; said p-th order LP synthesis filter and said p'-th order LP synthesis filter are formed by the same p-th order LP synthesis filter; said input codes contain an LP coefficient code; and said step (c) comprises the steps of:

(c-1) decoding said LP coefficient code into p-th order LP coefficients and setting them in said p-th order LP synthesis filter; and (c-2) performing an n-th order LPC analysis on an input signal to said p-th order LP synthesis filter to obtain n-th order LP coefficients and setting them in said n-th order LP synthesis filter.

33. The decoding method of claim 27, wherein: p'=p; said p-th order LP synthesis filter and said p'-th order LP synthesis filter are formed by the same p-th order LP synthesis filter; and said step (c) comprises the steps of:

(c-1) performing a p-th order LPC analysis on a previous synthesized acoustic signal to obtain p-th order LP coefficients and setting them in said p-th order LP synthesis filter;

(c-2) performing LP inverse filtering on said previous synthesized acoustic signal through the use of said p-th order LP coefficients to generate an LP residual signal; and (c-3) performing an n-th order LPC analysis on said LP residual signal to obtain n-th order LP coefficients and setting them in said n-th order LP synthesis filter.

34. The decoding method of claim 27, wherein: p'=p; said p-th order LP synthesis filter and said p'-th order LP synthesis filter are formed by the same p-th order LP synthesis filter; and said step (c) comprises the steps of:

(c-1) performing a p-th order LPC analysis on a previous synthesized acoustic signal to obtain p-th order LP coefficients and setting them in said p-th order synthesis filter; and (c-2) performing an n-th order LPC analysis on an input signal to said p-th order synthesis filter to obtain n-th order LP coefficients and setting them in said n-th order synthesis filter.

35. The decoding method of claim 27, wherein: p'=p; said p-th order LP synthesis filter and said p'-th order LP synthesis filter are formed by the same p-th order LP synthesis filter; said input codes contain an LP coefficient code; and said step (c) comprises the steps of:

(c-1) decoding said LP coefficient code into p-th order LP coefficients and setting them in said p-th order LP synthesis filter; and (c-2) decoding said LP coefficient code into n-th order LP coefficients and setting them in said n-th order LP synthesis filter.

36. The decoding method according to any one of claims 27 to 35, wherein said excitation vector codebook and said gain codebook respectively comprise a first excitation vector codebook and a first gain codebook prepared using said p-th order synthesis filter, and a second excitation vector codebook and a second gain codebook prepared using said cascade-connected synthesis filter, said first and second excitation vector codebooks and said first and second gain codebooks being selectively used in accordance with said mode code.

37. An audio decoding apparatus for decoding an acoustic signal from input codes containing at least a codebook index, a gain index and a mode code, said apparatus:

an excitation vector codebook which stores excitation vectors and outputs an excitation vector selected by said codebook index;

gain providing means for providing a gain, selected from a gain codebook corresponding to said gain index, to said selected excitation vector to generate an excitation signal;

synthesis filter means composed of a p-th order LP synthesis filter and a cascade-connected synthesis filter formed by a cascade connection of a p'- and n-th order LP synthesis filters, either one of said p-th order LP synthesis filter and said cascade-connected synthesis filter being selected and driven by said excitation signal to generate a synthesized acoustic signal, and said order p being equal or nearly equal to said order p';

coefficients setting means for generating p-th order LP coefficients, p'-th order LP coefficients and n-th order LP coefficients from at least one of said input code and a previous synthesized acoustic signal and for setting them in said p-th order LP synthesis filter, said p'-th order LP synthesis filter and said n-th order LP synthesis filter, respectively, said order n being higher than said order p; and mode switching means for selecting one of said p-th order LP synthesis filter and said cascade-connected synthesis filter in accordance with said mode code.

38. The decoding apparatus of claim 37, wherein said codes contain an LP coefficient code and said coefficients setting means comprises:

coefficients decoding means for decoding said LP coefficient code into said p-th order LP coefficients and for setting them in said p-th order LP synthesis filter;

p'-th order LPC analysis means for performing a p'-th order LPC analysis on a previous synthesized acoustic signal to obtain p'-th order LP coefficients and for setting them in said p'-th order LP synthesis filter;

an LP inverse filter for performing inverse filtering on said previous synthesized acoustic signal through the use of said p'-th order LP coefficients to obtain a LP residual signal; and n-th order LPC analysis means for performing an n-th order LPC analysis on said LP residual signal to obtain n-th order LP coefficients and for setting them in said n-th order LP filter.

39. The decoding apparatus of claim 37, wherein said input codes contain an LP coefficient code and said coefficients setting means comprises:

coefficients decoding means for decoding said LP coefficient code into p-th order LP coefficients and for setting them in said p-th order LP synthesis filter;

p'-th order LPC analysis means for performing a p'-th order LPC analysis on a previous synthesized acoustic signal to obtain p'-th order LP coefficients and for setting them in said p'-th order LP synthesis filter; and n-th order LPC analysis means for performing an n-th order LPC analysis on said excitation signal to obtain n-th order LP coefficients and for setting them in said n-th order synthesis filter.

40. The decoding apparatus of claim 37, wherein said input codes contain an LP coefficient code and said coefficients setting means comprises coefficients decoding means for decoding said LP coefficient code to p-th order LP coefficients, p'-th order LP coefficients and n-th order LP coefficients and for setting them in said p-th order LP synthesis filter, said p'-order LP synthesis filter and said n-th order LP synthesis filter, respectively.

41. The decoding apparatus of claim 37, wherein: p'=p; said p-th order LP synthesis filter and said p'-th order LP synthesis filter are formed by the same p-th order LP synthesis filter; said input codes contain LP coefficients code; and said coefficients setting means comprises:

coefficients decoding means for decoding said LP coefficient code into p-th order LP coefficients and for setting them in said p-th order LP synthesis filter;

inverse filter means for performing LP inverse filtering on a previous synthesized acoustic signal through the use of said p-th order LP coefficients to generate an LP residual signal; and LPC analysis means for performing an n-th order LPC analysis on said LP residual signal to obtain n-th order LP coefficients and for setting them in said n-th order LP synthesis filter.

42. The decoding apparatus of claim 37, wherein: p'=p; said p-th order LP synthesis filter and said p'-th order LP synthesis filter are formed by the same p-th order LP synthesis filter; said input codes contain an LP coefficient code; and said coefficients setting means comprises:

coefficients decoding means for decoding said LP coefficient code into p-th order LP coefficients and for setting them in said p-th order LP synthesis filter; and n-th order LPC analysis means for performing an n-th order LPC analysis on an input signal to said p-th order LP synthesis filter to obtain n-th order LP coefficients and for setting them in said n-th order LP synthesis filter.

43. The decoding apparatus of claim 37, wherein: p'=p; said p-th order LP synthesis filter and said p'-th order LP synthesis filter are formed by the same p-th order LP synthesis filter; and said coefficients setting means comprises:

p-th order LPC analysis means for performing a p-th order LPC analysis on a previous synthesized acoustic signal to obtain p-th order LP coefficients and for setting them in said p-th order LP synthesis filter;

inverse filter means for performing LP inverse filtering on said previous synthesized acoustic signal through the use of said p-th order LP coefficients to generate an LP residual signal; and n-th order LPC analysis means for performing an n-th order LPC analysis on said LP residual signal to obtain n-th order LP coefficients and for setting them in said n-th order LP synthesis filter.

44. The decoding apparatus of claim 37, wherein: p'=p; said p-th order LP synthesis filter and said p'-th order LP synthesis filter are formed by the same p-th order LP synthesis filter; said input codes contains an LP coefficient code; and said coefficients setting means comprises:

p-th order LPC analysis means for performing a p-th order LPC analysis on a previous synthesized acoustic signal to obtain p-th order LP coefficients and for setting them in said p-th order synthesis filter; and n-th order LPC analysis means for performing an n-th order LPC analysis on an input signal to said p-th order synthesis filter to obtain n-th order LP coefficients and for setting them in said n-th order synthesis filter.

45. The decoding apparatus of claim 37, wherein: p'=p; said p-th order LP synthesis filter and said p'-th order LP synthesis filter are formed by the same p-th order LP synthesis filter; said input codes contain an LP coefficient code; and said coefficients setting means comprises coefficients decoding means for decoding said LP coefficient code into p-th order LP coefficients and n-th order LP coefficiens and for setting them in said p-th order LP synthesis filter and said n-th order LP synthesis filter, respectively.

46. The decoding apparatus of any one of claims 38 to 45, wherein said excitation vector codebook and said gain codebook respectively comprise a first excitation vector codebook and a first gain codebook prepared using said p-th order synthesis filter, and a second excitation vector codebook and a second gain codebook prepared using said cascade-connected synthesis filter, said first and second excitation vector codebooks and said first and second gain codebooks being selectively used in accordance with said mode code.

47. A recording medium with an audio coding program recorded thereon, said program comprising the steps of:

(a) estimating said synthesized acoustic signal for said input acoustic signal;

(b) determining, from at least one of said input acoustic signal and said estimated synthesized acoustic signal, coefficients of a p-th order first LP synthesis filter and coefficients of a cascade-connected synthesis filter composed of a p'-th order second LP synthesis filter and an n-th order third LP synthesis filter, said order p' being equal or nearly equal to or said order p and said order n being higher than said order p;

(c) estimating, as first and second excitation signals for driving said first LP synthesis filter and said cascade-connected synthesis filter, respectively, first and second residual signals obtained by inverse filtering of said estimated synthesized acoustic signal by a first inverse filter of an inverse characteristic to said first LP synthesis filter and a second inverse filter of an inverse characteristic to said cascade-connected synthesis filter;

(d) determining from said first and second excitation signals which of said first LP synthesis filter and said cascade-connected synthesis filter will provide higher coding quality, and based on the result of determination, selecting, as a synthesis filter for audio coding, that one of said first LP synthesis filter and said cascade-connected synthesis filter which will provide higher coding quality;

(e) adding a gain to an excitation vector selected from codebook means to obtain an excitation signal, generating a synthesized acoustic signal by applying said excitation signal to that one of said first LP synthesis filter and said cascade-connected synthesis filter selected as said synthesis filter for audio coding, and computing an error between said input acoustic signal and said synthesized acoustic signal;

(f) determining said excitation vector and said gain which will minimize said error between said synthesized acoustic signal generated by repeating said step (e) and said input acoustic signal; and (g) outputting at least codebook indices representing said determined excitation vector, a gain index representing said determined gain and a mode code representing which one of said first LP synthesis filter and said cascade-connected synthesis filter has been selected.

48. The recording medium of claim 47, wherein said step (b) comprises the steps of:

(b-1) performing a p-th order LPC analysis on said input acoustic signal to obtain first LP coefficients and setting them in said first LP synthesis filter;

(b-2) performing a p'-th order LPC analysis on a previous synthesized acoustic signal to obtain second LP coefficients;

(b-3) performing LP inverse filtering on said previous synthesized acoustic signal based on said second LP coefficients to obtain an LP residual signal;

(b-4) performing an n-th order LPC analysis on said LP residual signal to obtain third LP coefficients; and (b-5) setting said second LP coefficients and said third LP coefficients in said second and third LP synthesis filters of said cascade-connected synthesis filter, respectively; and wherein said codebook indices in said step (g) contain a code indicating said first LP coefficients.

49. The recording medium of claim 47, wherein said step (b) comprises the steps of:

(b-1) performing a p-th order LPC analysis on said input acoustic signal to obtain first LP coefficients and setting them in said first LP synthesis filter;

(b-2) performing a p'-th order LPC analysis on a previous synthesized acoustic signal to obtain second LP coefficients;

(b-3) performing an n-th order LPC analysis on a previous excitation signal to obtain an LP residual signal;

(b-4) performing an n-th order LPC analysis on said LP residual signal to obtain third LP coefficients; and (b-5) setting said second LP coefficients and said third LP coefficients in said second and third LP synthesis filters of said cascade-connected synthesis filter, respectively; and wherein said codebook indices in said step (g) contain a code indicating said first LP coefficients.

50. The recording medium of claim 47, wherein: p=p'; said first and second LP synthesis filters are formed by the same p-th order synthesis filter; and said step (b) comprises the steps of:

(b-1) performing a p-th order LPC analysis on said input acoustic signal to obtain first LP coefficients;

(b-2) performing LP inverse filtering on said input acoustic signal based on said first LP coefficients to obtain an LP residual signal;

(b-3) performing an n-th order LPC analysis on said LP residual signal to obtain second LP coefficients; and (b-4) setting said first LP coefficients and said second LP coefficients in said p-th order synthesis filter and said second LP synthesis filter, respectively; and wherein said codebook indices in said step (g) contain a code indicating said first LP coefficients and a code indicating said n-th order LP coefficients.

51. The recording medium of claim 47, wherein: p=p'; said first and second LP synthesis filters are formed by the same p-th order synthesis filter; and said step (b) comprises the steps of:

(b-1) performing a p-th order LPC analysis on said input acoustic signal to obtain first LP coefficients;

(b-2) performing an n-th order LPC analysis on a previous excitation signal to obtain second LP coefficients; and (b-3) setting said first LP coefficients and said second LP coefficients in said p-th order synthesis filter and said second LP synthesis filter, respectively; and wherein said codebook indices in said step (g) contain a code indicating said first LP coefficients.

52. The recording medium of claim 47, wherein: p=p'; said first and second LP synthesis filters are formed by the same p-th order synthesis filter; and said step (b) comprise the steps of:

(b-1) performing a p-th order LPC analysis on a previous synthesized acoustic signal to obtain first LP coefficients;

(b-2) performing LP inverse filtering on said previous synthesized acoustic signal based on said first LP coefficients to obtain an LP residual signal;

(b-3) performing an n-th order LPC analysis on said LP residual signal to obtain second LP coefficients; and (b-4) setting said first LP coefficients and said second LP coefficients in said p-th order synthesis filter and said second LP synthesis filter, respectively.

53. The recording medium of claim 47, wherein: p=p'; said first and second LP synthesis filters are formed by the same p-th order synthesis filter; and said step (b) comprises the steps of:

(b-1) performing a p-th order LPC analysis on a previous synthesized acoustic signal to obtain first LP coefficients;

(b-2) performing an n-th order LPC analysis on a previous excitation signal to obtain second LP coefficients; and (b-3) setting said first LP coefficients and said second LP coefficients in said p-th order synthesis filter and said second LP synthesis filter, respectively.

54. A recording medium having recorded thereon an audio decoding program for decoding an acoustic signal from input codes containing at least a codebook index, a gain index and a mode code, said program comprising the steps of:

(a) selecting an excitation vector from an excitation vector codebook by said codebook index;

(b) providing a gain, selected from a gain codebook by said gain index, to said excitation vector to generate an excitation signal;

(c) generating p-th order LP coefficients, p'-th order LP coefficients and n-th order LP coefficients from at least one of said input code and a previous synthesized acoustic signal and setting them in a p-th order LP synthesis filter, a p'-th order LP synthesis filter and an n-th order LP synthesis filter, respectively, said order p being equal to or about the same as said p' and said n being higher than said p;

(d) selecting one of said p-th order LP synthesis filter and a cascade-connected synthesis filter composed of p'- and n-th order LP synthesis filters cascade-connected to each other in accordance with said mode code; and (e) driving said selected one of said p-th order LP synthesis filter and said cascade-connected synthesis filter by said excitation signal to generate a synthesized acoustic signal.

55. The recording medium of claim 54, wherein said input codes contain an LP coefficient code and said step (c) comprises the steps of:

(c-1) decoding said LP coefficient code into a p-th order LP coefficients and setting them in said p-th order LP synthesis filter;

(c-2) performing an LPC analysis on a previous synthesized acoustic signal to obtain a p'-th order LP coefficients and setting them in said p'-th order LP synthesis filter;

(c-3) performing inverse filtering on said previous synthesized acoustic signal by an LP inverse filter having set therein said p'-th order LP coefficients to obtain an LP residual signal; and (c-4) performing an n-th order LPC analysis on said LP residual signal to obtain an n-th order LP coefficients and setting them in said n-th order LP filter.

56. The recording medium of claim 54, wherein said input codes contain an LP coefficient code and said step (c) comprises the steps of:

(c-1) decoding said LP coefficient code into p-th order LP coefficients and setting them in said p-th order LP synthesis filter;

(c-2) performing an LPC analysis on a previous synthesized acoustic signal stored in a synthesized acoustic signal buffer to obtain p'-th order second LP coefficients and setting them in said p'-th order LP synthesis filter;

(c-3) performing an n-th order LPC analysis on a previous excitation signal stored in an excitation signal buffer to obtain an n-th order LP coefficients and setting them in said n-th order LP filter; and (c-4) selecting said excitation signal or the output signal from said n-th order LP synthesis filter in accordance with said mode code and storing it in as said previous excitation signal in said excitation signal buffer.

57. The recording medium of claim 54, wherein said input codes contain an LP coefficient code and said step (c) comprises the steps of:

(c-1) decoding said LP coefficient code to p-th order LP coefficients and setting it in said p-th order LP synthesis filter; and (c-2) decoding said LP coefficient code into p'- and n-th order LP coefficients and setting them in said p'- and n-th order LP synthesis filters forming said cascade-connected synthesis filter, respectively.

58. The recording medium of claim 54, wherein: p'=p; said p-th order LP synthesis filter and said p'-th order LP synthesis filter are formed by the same p-th order LP synthesis filter; said input codes contain an LP coefficient code; and said step (c) comprises the steps of:

(c-1) decoding said LP coefficient code into p-th order LP coefficients and setting them in said p-th order LP synthesis filter;

(c-2) performing LP inverse filtering on a previous synthesized acoustic signal through the use of said p-th order LP coefficients to generate an LP residual signal; and (c-3) performing an n-th order LPC analysis on said LP residual signal to obtain an n-th order LP coefficients and setting them in said n-th order LP synthesis filter.

59. The recording medium of claim 54, wherein: p'=p; said p-th order LP synthesis filter and said p'-th order LP synthesis filter are formed by the same p-th order LP synthesis filter; said input codes contain an LP coefficient code; and said step (c) comprises the steps of:

(c-1) decoding said LP coefficient code into p-th order LP coefficients and setting them in said p-th order LP synthesis filter; and (c-2) performing an n-th order LPC analysis on an input signal to said p-th order LP synthesis filter to obtain n-th order LP coefficients and setting them in said n-th order LP synthesis filter.

60. The recording medium of claim 54, wherein: p'=p; said p-th order LP synthesis filter and said p'-th order LP synthesis filter are formed by the same p-th order LP synthesis filter; and said step (c) comprises the steps of:

(c-1) performing a p-th order LPC analysis on a previous synthesized acoustic signal to obtain p-th order LP coefficients and setting them in said p-th order LP synthesis filter;

(c-2) performing LP inverse filtering on said previous synthesized acoustic signal through the use of said p-th order LP coefficients to generate an LP residual signal; and (c-3) performing an n-th order LPC analysis on said LP residual signal to obtain n-th order LP coefficients and setting them in said n-th order LP synthesis filter.

61. The recording medium of claim 54, wherein: p'=p; said p-th order LP synthesis filter and said p'-th order LP synthesis filter are formed by the same p-th order LP synthesis filter; and said step (c) comprises the steps of:

(c-1) performing a p-th order LPC analysis on a previous synthesized acoustic signal to obtain p-th order LP coefficients and setting them in said p-th order synthesis filter; and (c-2) performing an n-th order LPC analysis on an input signal to said p-th order synthesis filter to obtain n-th order LP coefficients and setting them in said n-th order synthesis filter.

62. The recording medium of claim 54, wherein: p'=p; said p-th order LP synthesis filter and said p'-th order LP synthesis filter are formed by the same p-th order LP synthesis filter; said input codes contain an LP coefficient code; and said step (c) comprises the steps of:

(c-1) decoding said LP coefficient code into p-th order LP coefficients and setting them in said p-th order LP synthesis filter; and (c-2) decoding said LP coefficient code into n-th order LP coefficients and setting them in said n-th order LP synthesis filter.

* * * * *